US011959649B2

(12) United States Patent
Kibe et al.

(10) Patent No.: US 11,959,649 B2
(45) Date of Patent: Apr. 16, 2024

(54) AIR-CONDITIONING APPARATUS

(71) Applicant: Mitsubishi Electric Corporation, Tokyo (JP)

(72) Inventors: Atsushi Kibe, Tokyo (JP); Yoji Onaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 308 days.

(21) Appl. No.: 17/603,081

(22) PCT Filed: Feb. 17, 2020

(86) PCT No.: PCT/JP2020/005955
§ 371 (c)(1),
(2) Date: Oct. 12, 2021

(87) PCT Pub. No.: WO2020/255484
PCT Pub. Date: Dec. 24, 2020

(65) Prior Publication Data

US 2022/0186943 A1 Jun. 16, 2022

(30) Foreign Application Priority Data

Jun. 17, 2019 (WO) ..... PCT/JP2019/023838

(51) Int. Cl.
*F25B 39/02* (2006.01)
*F24F 1/18* (2011.01)
*F24F 13/20* (2006.01)

(52) U.S. Cl.
CPC ..... *F24F 1/18* (2013.01); *F25B 39/02* (2013.01); *F24F 2013/202* (2013.01); *F24F 2221/16* (2013.01)

(58) Field of Classification Search
CPC .... F24F 1/18; F24F 2013/202; F24F 2221/16; F24F 1/50; F25B 39/02;
(Continued)

(56) References Cited

U.S. PATENT DOCUMENTS 5,579,835 A 12/1996 Chiba et al.
2015/0122470 A1 5/2015 Xia et al.
(Continued)

FOREIGN PATENT DOCUMENTS

EP 3 805 651 A1 4/2021
JP H07-063492 A 3/1995
(Continued)

OTHER PUBLICATIONS

Decision of Rejection dated Dec. 26, 2022 issued in corresponding CN Patent Application No. 202080042557.5 (and English machine translation).
(Continued)

*Primary Examiner* — Ana M Vazquez
(74) *Attorney, Agent, or Firm* — POSZ LAW GROUP, PLC

(57) ABSTRACT

An air-conditioning apparatus includes a compressor and an outdoor heat exchanger that operates as an evaporator. A first heat exchange unit of the outdoor heat exchanger includes: first heat transfer tubes extending in an upward/downward direction, and arranged apart from each other in a lateral direction; a first junction pipe extending in the lateral direction, and connected to the lower ends of the first heat transfer tubes; an outflow pipe connected to the first junction pipe at or below a center position of the first junction pipe in the upward/downward direction; second heat transfer tubes extending in the upward/downward direction, and arranged apart from each other in the lateral direction; a first distribution pipe extending in the lateral direction, and connected to the lower ends of the second heat transfer tubes, and a first connection part connecting upper ends of the first heat transfer tubes and upper ends of the second heat transfer tubes.

8 Claims, 9 Drawing Sheets

(58) Field of Classification Search
CPC ..... F25B 2313/0233; F25B 2313/0253; F25B 2313/02731; F25B 2313/02741; F25B 13/00; F28D 1/0408; F28D 1/0435; F28D 2001/0273; F28D 2021/0068; F28F 9/0273
See application file for complete search history.

(56) References Cited

U.S. PATENT DOCUMENTS

| | | | | |
|---|---|---|---|---|
| 2017/0122630 | A1* | 5/2017 | Okazaki | F25B 40/00 |
| 2018/0135900 | A1 | 5/2018 | Jindou et al. | |
| 2018/0180306 | A1 | 6/2018 | Aoyama | |

FOREIGN PATENT DOCUMENTS

| | | | |
|---|---|---|---|
| JP | H09-280754 | A | 10/1997 |
| JP | H10-267586 | A | 10/1998 |
| JP | 2015-034670 | A | 2/2015 |
| JP | 2017-032244 | A | 2/2017 |
| WO | 2015/162689 | A1 | 10/2015 |
| WO | 2016/174830 | A1 | 11/2016 |
| WO | 2017/017813 | A1 | 2/2017 |

OTHER PUBLICATIONS

Office Action dated Sep. 2, 2022 issued in corresponding CN Patent Application No. 202080042557.5 (and English machine translation).

International Search Report dated Aug. 20, 2019, issued in corresponding International Application No. PCT/JP2019/023838 (and English Machine Translation).

International Search Report dated Apr. 21, 2020, issued in corresponding International Application No. PCT/JP2020/005955 (and English Machine Translation).

Extended European Search Report dated Jul. 4, 2022 issued in corresponding European Patent Application No. 20826930.8.

* cited by examiner

AIR-CONDITIONING APPARATUS

CROSS-REFERENCE TO RELATED APPLICATION

This application is a U.S. National Stage Application of International Application No. PCT/JP2020/005955 filed on Feb. 17, 2020, which designated the U.S. and claims the benefit of priority from PCT/JP2019/023838 filed on Jun. 17, 2019. The entire disclosures of all of the above applications are incorporated herein by reference.

TECHNICAL FIELD

The present disclosure relates to an air-conditioning apparatus that can perform at least a heating operation.

BACKGROUND

As an existing outdoor heat exchanger of an air-conditioning apparatus, an outdoor heat exchanger including a plurality of heat transfer tubes, a distribution pipe, and a junction pipe is well known (for example, see Patent Literature 1). The distribution pipe is connected to a refrigerant inflow-side end of each of the heat transfer tubes, and distributes refrigerant that flows in the distribution pipe to the heat transfer tubes connected to the distribution pipe. The junction pipe is connected to a refrigerant outflow-side end of each of the heat transfer tubes, and allow refrigerant that flows out of the heat transfer tubes connected to the junction pipe to join each other in the junction pipe. In the existing outdoor heat exchanger including the heat transfer tubes, the distribution pipe, and the junction pipe, the heat transfer tubes each extend in a lateral direction, and are arranged apart from each other in an upward/downward direction. Thus, the distribution pipe and the junction pipe each extend in the upward/downward direction. In the case where the air-conditioning apparatus performs the heating operation, that is, in the case where the outdoor heat exchanger operates as an evaporator, the refrigerant that flows out of the junction pipe is guided to a compressor, and is compressed by the compressor. More specifically, an outflow pipe that guides the refrigerant flowing out of the junction pipe to the compressor is connected to the junction pipe at a middle position thereof in the upward/downward direction. The refrigerant that flows out of the junction pipe flows into the outflow pipe, and is guided to the compressor through the outflow pipe.

PATENT LITERATURE

Patent Literature 1: PCT International Publication No. 2016/174830

In a compressor of an air-conditioning apparatus, refrigerating machine oil is stored to lubricate a sliding portion of the inside the compressor, and to seal a gap of a compression mechanism unit, and for other purposes. When the compressor compresses the refrigerant and discharges the compressed refrigerant, the refrigerating machine oil in the compressor partially flows out of the compressor along with the compressed refrigerant. The refrigerating machine oil that has flowed out of the compressor circulates in a refrigeration cycle circuit, and returns to the compressor. Therefore, in an air-conditioning apparatus employing the existing outdoor heat exchanger that includes the plurality of heat transfer tubes, the distribution pipe, and the junction pipe, during the heating operation in which the outdoor heat exchanger operates as an evaporator, the refrigerating machine oil that has flowed out of the compressor flows into the junction pipe from the heat transfer tubes and joins each other, and the refrigerating machine oil then returns to the compressor through the outflow pipe.

In the existing outdoor heat exchanger including the heat transfer tubes, the distribution pipe, and the junction pipe, the junction pipe extends in the upward/downward direction. Therefore, the refrigerating machine oil in the junction pipe easily collects at a lower end portion of the junction pipe because of the effect of gravity. Therefore, in the air-conditioning apparatus employing the existing outdoor heat exchanger that includes the heat transfer tubes, the distribution pipe, and the junction pipe, during the heating operation in which the outdoor heat exchanger operates as an evaporator, the refrigerating machine oil collects at the lower end portion of the junction pipe, and the compressor thus runs short of refrigerating machine oil, thus decreasing the reliability of the air-conditioning apparatus.

SUMMARY

The present disclosure is applied to solve the above problem, and relates to an air-conditioning apparatus that can prevent the inside of a compressor from running short of refrigerating machine oil because of collection of the refrigerating machine oil in a junction pipe.

An air-conditioning apparatus according to an embodiment of the present disclosure includes a compressor; and an outdoor heat exchanger configured to operate as at least an evaporator. The outdoor heat exchanger includes a first heat exchange unit. The first heat exchange unit includes: a plurality of first heat transfer tubes extending in an upward/downward direction, arranged apart from each other in a lateral direction, and having respective outflow-side ends from which refrigerant that flows in the plurality of first heat transfer tubes flows out when the outdoor heat exchanger operates as the evaporator, the outflow-side ends being lower ends of the plurality of heat transfer tubes; a first junction pipe extending in the lateral direction, connected to the outflow-side ends of the plurality of first heat transfer tubes, and provided as a pipe in which the refrigerant that flows out of the plurality of first heat transfer tubes joins each other when the outdoor heat exchanger operates as the evaporator; an outflow pipe connected to the first junction pipe at or below a center position of the first junction pipe in the upward/downward direction, and configured to guide the refrigerant that flows out of the first junction pipe to the compressor when the outdoor heat exchanger operates as the evaporator; a plurality of second heat transfer tubes extending in the upward/downward direction, arranged apart from each other in the lateral direction, and having respective inflow-side ends from which the refrigerant flows into the plurality of second heat transfer tubes when the outdoor heat exchanger operates as the evaporator, the inflow-side ends being lower ends of the plurality of second heat transfer tubes; a first distribution pipe extending in the lateral direction, connected to the inflow-side ends of the plurality of second heat transfer tubes, and configured to distribute the refrigerant that flows through the first distribution pipe to the plurality of second heat transfer tubes when the outdoor heat exchanger operates as the evaporator; and a first connection part connecting upper ends of the plurality of first heat transfer tubes and upper ends of the plurality of second heat transfer tubes, and configured to guide the refrigerant that flows out of the plurality of second heat transfer tubes to the plurality of first heat transfer tubes when the outdoor heat exchanger operates as the evaporator.

In the air-conditioning apparatus according to the embodiment of the present disclosure, the first junction pipe of the outdoor heat exchanger extends in the lateral direction. Furthermore, in the air-conditioning apparatus according to the embodiment of the present disclosure, the outflow pipe is connected to the first junction pipe at or below the center position of the first junction pipe in the upward/downward direction. Therefore, in the air-conditioning apparatus according to the embodiment of the present disclosure, it is possible to reduce accumulation of refrigerating machine oil at part of the first junction pipe where the refrigerating machine oil does not easily flows out from the outflow pipe, and to reduce shortage of the refrigerating machine oil in the compressor.

DETAILED DESCRIPTION

Embodiment

Figure 1:
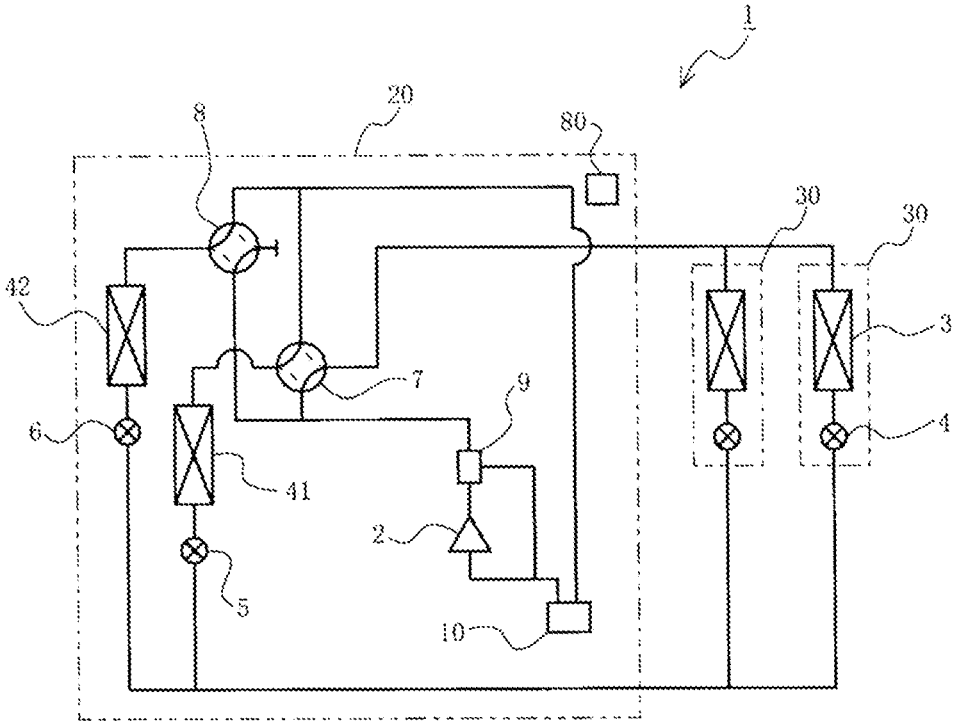
FIG. 1 is a refrigerant circuit diagram of an air-conditioning apparatus according to an embodiment.

FIG. 1 is a refrigerant circuit diagram of an air-conditioning apparatus according to an embodiment.

An air-conditioning apparatus 1 includes a compressor 2, indoor heat exchangers 3 that operate as condensers, expansion valves 4, and outdoor heat exchangers that operate as evaporators. The compressor 2, the indoor heat exchangers 3, the expansion valves 4, and the outdoor heat exchangers are connected by refrigerant pipes to form a refrigeration cycle circuit. It should be noted that the kind of refrigerant that circulates in the refrigeration cycle circuit is not limited. Various kinds of refrigerants such as R410A, R32, and CO2 are usable as refrigerant that circulates in the refrigeration cycle circuit according to the present embodiment.

The compressor 2 compresses the refrigerant. The refrigerant compressed by the compressor 2 is discharged and is sent to the indoor heat exchangers 3. The compressor 2 is, for example, a rotary compressor, a scroll compressor, a screw compressor, or a reciprocating compressor.

The indoor heat exchangers 3 operate as condensers during the heating operation. Each of the indoor heat exchangers 3 is, for example, a fin-and-tube heat exchanger, a microchannel heat exchanger, a shell-and-tube heat exchanger, a heat pipe heat exchanger, a double-pipe heat exchanger, or a plate heat exchanger.

Each of the expansion valves 4 expands refrigerant that flows out of an associate one of the condensers and reduces the pressure of the refrigerant. It is appropriate that as each of the expansion valves 4, for example, an electric expansion valve that can adjust a flow rate of the refrigerant is applied.

The outdoor heat exchangers operate as evaporators during the heating operation. In the present embodiment, two outdoor heat exchangers are provided. To be more specific, in the embodiment, an outdoor heat exchanger 41 and an outdoor heat exchanger 42 are provided. The outdoor heat exchanger 41 and the outdoor heat exchanger 42 are connected in parallel between the expansion valves 4 and a suction side of the compressor 2. In addition, in the embodiment, the refrigeration cycle circuit of the air-conditioning apparatus 1 includes an expansion valve 5 that adjusts a flow rate of refrigerant that flows in the outdoor heat exchanger 41, and an expansion valve 6 that adjusts the flow rate of refrigerant that flows in the outdoor heat exchanger 42. A detailed configuration of each of the outdoor heat exchangers 41 and 42 will be described later It should be noted that the number of outdoor heat exchangers included in the air-conditioning apparatus 1 may be one or three or more.

In order to perform a cooling operation in addition to the heating operation, the air-conditioning apparatus 1 further includes a flow switching device 7 and a flow switching device 8 provided on a discharge side of the compressor 2. Each of the flow switching device 7 and the flow switching device 8 switches the flow of the refrigerant between the flow of the refrigerant in the cooling operation and that in the heating operation. In the embodiment, four-way valves are used as the flow switching device 7 and the flow switching device 8. Furthermore, as illustrated in FIG. 1, in the air-conditioning apparatus 1 according to the embodiment, a plurality of sets of flow switching devices, outdoor heat exchangers, and expansion valves are connected in parallel and the flow switching device, the outdoor heat exchanger and the expansion valve of each of the plurality of sets are connected in series. It should be noted that each of the flow switching device 7 and the flow switching device 8 may be, for example, a two-way valve or a three-way valve.

The flow switching device 7 switches a flow passage between a flow passage that causes the outdoor heat exchanger 41 to be connected to a discharge side of the compressor 2 and a flow passage that causes the outdoor heat exchanger 41 to be connected to a suction side of the compressor 2. More specifically, during the cooling operation, the flow switching device 7 switches the flow passage to the flow passage that causes the outdoor heat exchanger 41 to be connected to the discharge side of the compressor 2. At this time, the flow passage in the flow switching device 7 connects the suction side of the compressor 2 and the indoor heat exchangers 3. During the heating operation, the flow switching device 7 switches the flow passage to the flow passage that causes the outdoor heat exchanger 41 to be connected to the suction side of the compressor 2. At this time, the flow passage in the flow switching device 7 causes the discharge side of the compressor 2 and the indoor heat exchangers 3 to be connected to each other. The flow switching device 8 switches a flow passage to a flow passage that causes the outdoor heat exchanger 42 to the discharge side of the compressor 2 and a flow passage that cause the outdoor heat exchanger 42 to the suction side of the compressor 2. More specifically, during the cooling operation, the flow switching device 8 switches the flow passage to the flow passage that causes the outdoor heat exchanger 42 to be connected to the discharge side of the compressor 2. During the heating operation, the flow switching device 8 switches the flow passage to the flow passage that causes the outdoor heat exchanger 42 to be connected to the suction side of the compressor 2. In other words, during the cooling operation, the outdoor heat exchanger 41 and the outdoor heat exchanger 42 each operate as a condenser, and the indoor heat exchangers 3 each operate as an evaporator.

Furthermore, the air-conditioning apparatus 1 includes an accumulator 10 that accumulates surplus refrigerant in the refrigeration cycle circuit. The accumulator 10 is provided on the suction side of the compressor 2. The air-conditioning apparatus 1 further includes an oil separator 9 that separates refrigerating machine oil from the refrigerant discharged from the compressor 2. The oil separator 9 is provided on the discharge side of the compressor 2. The refrigerating machine oil separated from the refrigerant by the oil separator 9 is returned to a refrigerant pipe that connects the compressor 2 and the accumulator 10.

The air-conditioning apparatus 1 further includes a controller 80. The controller 80 is dedicated hardware or a central processing unit (CPU) that executes a program stored in a memory. The CPU is also referred to as a central processing device, a processing device, a calculation device, a microprocessor, a microcomputer, or a processor.

In the case where the controller 80 is the dedicated hardware, the controller 80 corresponds to, for example, a single circuit, a composite circuit, an application specific integrated circuit (ASIC), a field-programmable gate array (FPGA), or a combination thereof. Functions that are fulfilled by the controller 80 may be fulfilled by respective hardware or may be single hardware; that is, functional part of the controller 80 may be respective hardware or single hardware.

In the case where the controller 80 is the CPU, functions that are fulfilled by the controller 80 are fulfilled by software, firmware, or a combination of software and firmware. The software and the firmware are described as programs and stored in the memory. The CPU fulfills the functions of the controller 80 by reading out and executing the programs stored in the memory. The memory is, for example, a nonvolatile or volatile semiconductor memory such as a RAM, a ROM, a flash memory, an EPROM, and an EEPROM.

Part of the functions of the controller 80 may be fulfilled by dedicated hardware, and another part of the functions may be fulfilled by software or firmware.

The controller 80 controls each of actuators in the air-conditioning apparatus 1. To be more specific, the controller 80 includes a control unit as a functional unit that controls each of the actuators of the air-conditioning apparatus 1. For example, the controller 80 controls starting of the compressor 2, stop of the compressor 2, a driving frequency of the compressor 2, opening degrees of the expansion valves 4, an opening degree of the expansion valve 5, and an opening degree of the expansion valve 6. Furthermore, for example, the controller 80 controls the flow switching device 7 and the flow switching device 8 to change each of the flow passage in the flow switching device 7 and the flow passage in the flow switching device 8 in a switching manner.

The above components included in the air-conditioning apparatus 1 are housed in any of an outdoor unit 20 and indoor units 30. In the present embodiment, the compressor 2, the expansion valve 5, the expansion valve 6, the flow switching device 7, the flow switching device 8, the oil separator 9, the accumulator 10, the outdoor heat exchanger 41, the outdoor heat exchanger 42, and the controller 80 are housed in the outdoor unit 20. Furthermore, in the indoor units 30, respective indoor heat exchangers 3 and respective expansion valves 4 are provided. It should be noted that in the embodiment, the two indoor units 30 are arranged in parallel; however, the number of indoor units 30 is arbitrary.

Figure 2:
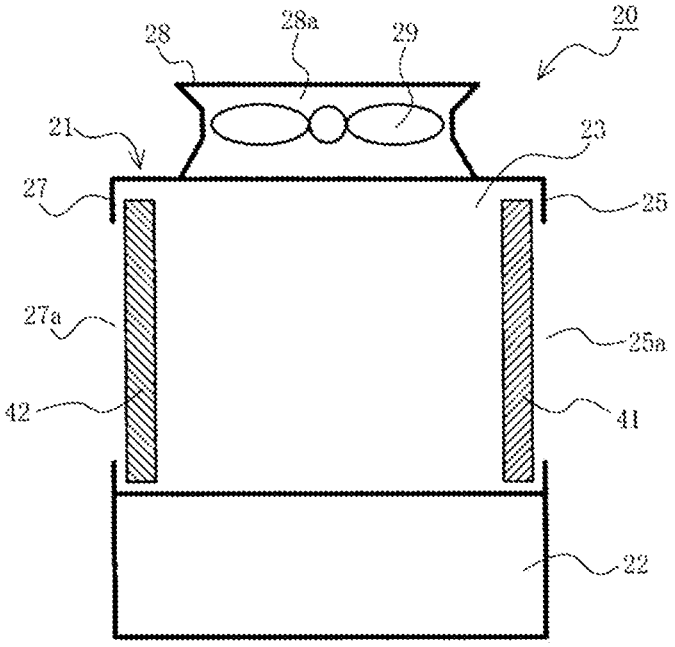
FIG. 2 is a vertical sectional view of an outdoor unit of the air-conditioning apparatus according to the embodiment.
Figure 3:
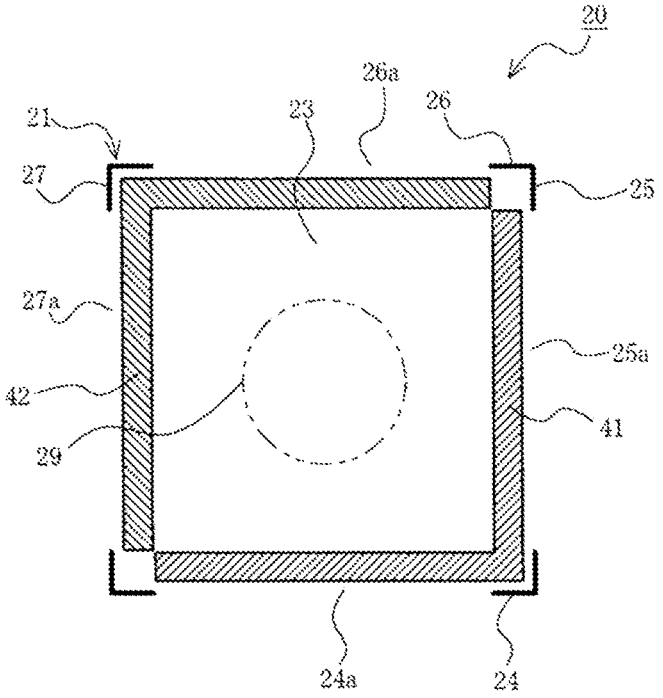
FIG. 3 is a cross-sectional view of the outdoor unit of the air-conditioning apparatus according to the embodiment.

FIG. 2 is a vertical sectional view of the outdoor unit of the air-conditioning apparatus according to the embodiment. FIG. 3 is a cross-sectional view of the outdoor unit of the air-conditioning apparatus according to the embodiment. To be more specific, FIG. 3 is a cross-sectional view of a fan chamber 23 in the outdoor unit 20. Furthermore, in FIG. 3, the position of a fan 29 in a planar view is indicated by a chain double-dashed line that is an imaginary line.

The outdoor unit 20 includes a housing 21 having a substantially cuboid shape. That is, the housing 21 has a quadrangular shape as viewed in plan view. A lower portion of the housing 21 is a machine chamber 22 that houses the compressor 2 and other components. An upper portion of the housing 21 is the fan chamber 23 that houses the fan 29, the outdoor heat exchanger 41, the outdoor heat exchanger 42, and other components.

In all side surfaces of the fan chamber 23, respective air inlets are provided. More specifically, an air inlet **24*a* is provided in a side surface 24; an air inlet 25*a* is provided in a side surface 25 adjacent to the side surface 24; an air inlet 26*a* is provided in a side surface 26 adjacent to the side surface 25; and an air inlet 27*a* is provided in a side surface 27 adjacent to the side surface 24 and the side surface 26. The outdoor heat exchanger 41 is L-shaped as viewed in plan view, and is housed in the fan chamber 23 in such a manner as to face the air inlet 24*a* and the air inlet 25*a*. In addition, the outdoor heat exchanger 42 is L-shaped as viewed in plan view, and is housed in the fan chamber 23 in such a manner as to face the air inlet 26*a* and the air inlet 27*a***.

An air outlet portion **28*a* is provided on an upper surface 28 of the fan chamber 23. Furthermore, a fan 29, for example, a propeller fan, is provided in the air outlet portion 28*a*. Therefore, outdoor air that is sucked into the fan chamber 23 from the air inlet 24*a* and the air inlet 25*a* by rotation of the fan 29 exchanges heat with the refrigerant that flows in the outdoor heat exchanger 41. Also, outdoor air that is sucked into the fan chamber 23 from the air inlet 26***a* and the air inlet 27*a* exchanges heat with the refrigerant that flows in the outdoor heat exchanger 42. The outdoor air that has been subjected to heat exchange at the outdoor heat exchanger 41 and the outdoor heat exchanger 42 is blown out from the air outlet portion 28*a* to the outside of the outdoor unit 20. As illustrated in FIG. 3, air inlets are formed in respective side surfaces of the fan chamber 23 of the housing 21. Furthermore, as viewed in plan view, four sides of the fan 29 are surrounded by the outdoor heat exchanger 41 and the outdoor heat exchanger 42. Because of provision of such a configuration, air can be uniformly sucked from the air inlets into the fan chamber 23 of the housing 21. As a result, it is possible to reduce noise made by the fan 29, and also reduce electricity consumption of the fan 29.

It should be noted that the above positions of the air inlets formed in the fan chamber 23 are described by way of example. For example, the fan chamber 23 may have a side surface having no air inlet. Furthermore, the above shape of each of the outdoor heat exchangers provided in the air-conditioning apparatus 1 as viewed in plan view is described by way of example. For example, the shape of each of the outdoor heat exchangers provided in the air-conditioning apparatus 1 as viewed in plan view may be a linear shape.

Figure 4:
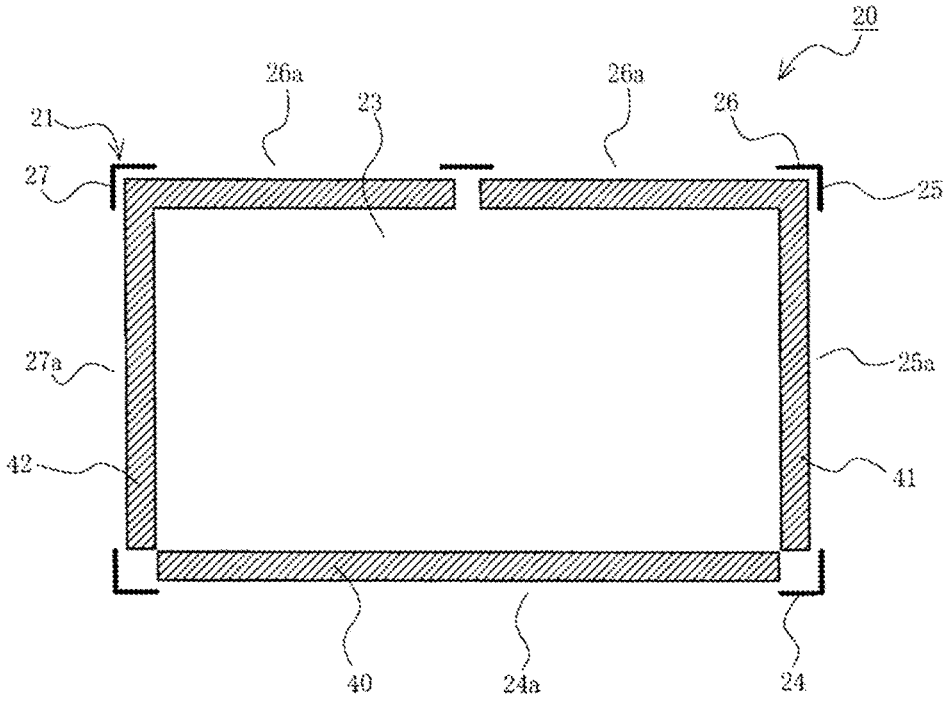
FIG. 4 is a cross-sectional view illustrating a modification of the outdoor unit of the air-conditioning apparatus according to the embodiment.

FIG. 4 is a cross-sectional view illustrating a modification of the outdoor unit of the air-conditioning apparatus according to the embodiment.

In the case where the outdoor unit 20 has a larger size, and all the sides of the fan 29 are surrounded by the two outdoor heat exchangers each having an L-shape as viewed in plan view as described above, each of the outdoor heat exchangers has a larger size. As a result, the workability at the time of setting the outdoor heat exchangers in the housing 21 is worsened. Therefore, in the case where the outdoor unit 20 has a larger size, preferably, all the sides of the fan 29 should be surrounded by three or more outdoor heat exchangers. For example, in the outdoor unit 20 of the air-conditioning apparatus 1 as illustrated in FIG. 4, all the sides of the fan 29 are surrounded by three outdoor heat exchangers as viewed in plan view. More specifically, the air-conditioning apparatus 1 as illustrated in FIG. 4 includes an outdoor heat exchanger 40, the outdoor heat exchanger 41, and the outdoor heat exchanger 42. The outdoor heat exchanger 40 is linearly shaped as viewed in plan view, and is housed in the fan chamber 23 of the outdoor unit 20 in such a manner as to face the air inlet 24*a* of the side surface 24. The outdoor heat exchanger 41 is L-shaped as viewed in plan view, and is housed in the fan chamber 23 of the outdoor unit 20 in such a manner as to face the air inlet 25*a* of the side surface 25 and the air inlet 26*a* of the side surface 26. The outdoor heat exchanger 42 is L-shaped as viewed in plan view, and is housed in the fan chamber 23 of the outdoor unit 20 in such a manner as to face the air inlet 26*a* of the side surface 26 and the air inlet 27*a* of the side surface 27.

In the case where the outdoor unit 20 has a larger size, all the sides of the fan 29 are surrounded by the three or more outdoor heat exchangers as described above. Thus, each of the outdoor heat exchangers does not need to be made larger, and the workability at the time of setting the outdoor heat exchangers in the housing 21 can be improved. It should be noted that the larger the number of flow switching devices, the larger the number of expansion valves connected in series with the outdoor heat exchangers and the number of outdoor heat exchangers. Therefore, the larger the number of outdoor heat exchangers, the higher the manufacturing cost of the air-conditioning apparatus 1. It is therefore preferable that the number of outdoor heat exchangers provided in the air-conditioning apparatus 1 be determined in consideration of the workability at the time of setting the outdoor heat exchangers in the housing 21 and the manufacturing cost of the air-conditioning apparatus 1.

Next, a detailed configuration of each of the outdoor heat exchanger 41 and the outdoor heat exchanger 42 will be described. The outdoor heat exchanger 41 and the outdoor heat exchanger 42 basically has the same configuration. Therefore, only the detailed configuration of the outdoor heat exchanger 41 will be described.

Figure 5:
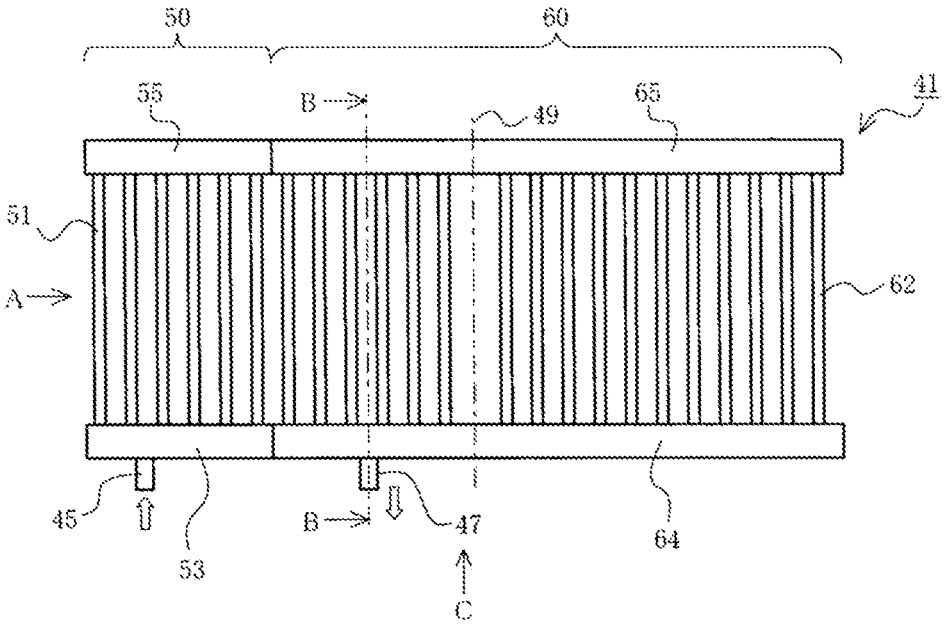
FIG. 5 is a side view of an outdoor heat exchanger according to the embodiment.
Figure 6:
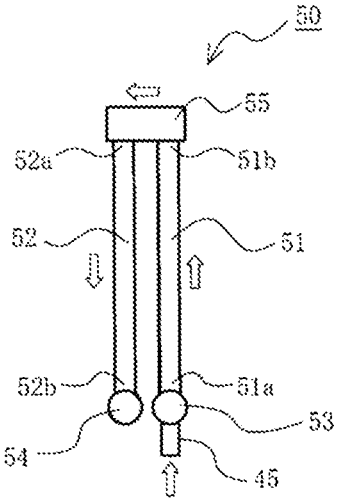
FIG. 6 is a diagram as viewed in a direction indicated by an arrow A in FIG. 5.
Figure 7:
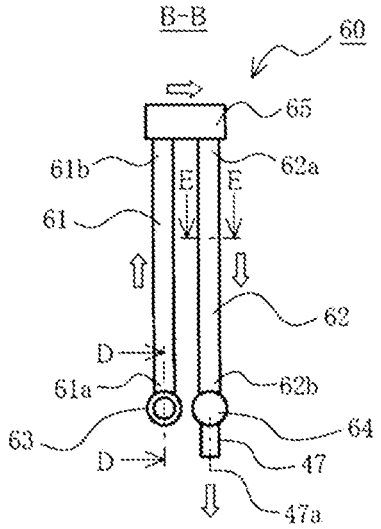
FIG. 7 is a sectional view taken along line B-B in FIG. 5.
Figure 8:
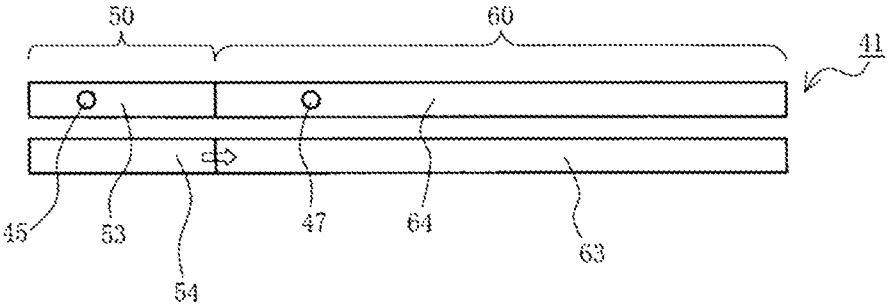
FIG. 8 is a diagram as viewed in a direction indicated by an arrow C in FIG. 5.
Figure 9:
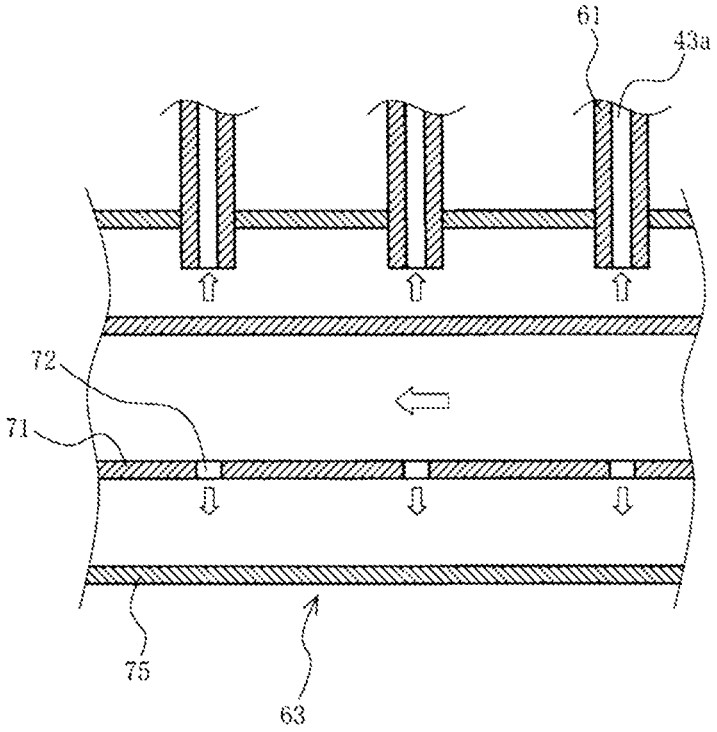
FIG. 9 is a sectional view taken along line D-D in FIG. 7.
Figure 10:
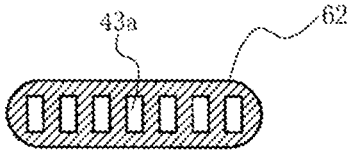
FIG. 10 is a sectional view taken along line E-E in FIG. 7.

FIG. 5 is a side view of an outdoor heat exchanger according to the embodiment. FIG. 5 illustrates the outdoor heat exchanger 41 that has not yet been L-shaped as viewed in plan view. To be more specific, when being folded at a folding position 49, the outdoor heat exchanger 41 as illustrated in FIG. 5 is L-shaped as viewed in plan view as illustrated in FIG. 3. FIG. 6 is a diagram as viewed in a direction indicated by an arrow A in FIG. 5. FIG. 7 is a sectional view taken along line B-B in FIG. 5. FIG. 8 is a diagram as viewed in a direction indicated by an arrow C in FIG. 5. FIG. 9 is a sectional view taken along line D-D in FIG. 7. FIG. 10 is a sectional view taken along line E-E in FIG. 7. Outlined arrows illustrated in FIGS. 5 to 9 indicate a flow direction of refrigerant that flows in the outdoor heat exchanger 41 during the heating operation in which the outdoor heat exchanger 41 operates as an evaporator.

The outdoor heat exchanger 41 includes a first heat exchange unit 60. The outdoor heat exchanger 41 may include the first heat exchange unit 60 only; however, the outdoor heat exchanger 41 according to the present embodiment includes a second heat exchange unit 50 in addition to the first heat exchange unit 60. The first heat exchange unit 60 and the second heat exchange unit 50 are connected in series. The second heat exchange unit 50 is located upstream of the first heat exchange unit 60 in the flow direction of the refrigerant when the outdoor heat exchanger 41 operates as an evaporator. In the following, the first heat exchange unit 60 is first described, and the second heat exchange unit 50 is then described.

The first heat exchange unit 60 includes a plurality of heat transfer tubes 62 that correspond to first heat transfer tubes, a junction pipe 64 that corresponds to a first junction pipe, an outflow pipe 47, a plurality of heat transfer tubes 61 that correspond to second heat transfer tubes, a distribution pipe 63 that corresponds to a first distribution pipe, and a connection part 65 that corresponds to a first connection part.

In each of the heat transfer tubes 62, refrigerant flow passages 43*a* are provided. In the present embodiment, as illustrated in FIG. 10, flat tubes are used as the heat transfer tubes 62. More specifically, a section of each of the heat transfer tubes 62 that is perpendicular to an extending direction of the refrigerant flow passages 43*a* has an elongated shape, for example, the section is elongated and circular on both sides. As described above, each of the heat transfer tubes 62 includes the plurality of refrigerant flow passages 43*a*. Each of the heat transfer tubes 61 is a flat tube that has a similar configuration to that of each of the heat transfer tubes 62. Each of heat transfer tubes 51 and heat transfer tubes 52, which will be described later, in the second heat exchange unit 50 is also a flat tube that has a similar configuration to that of each of the heat transfer tubes 62. It should be noted that circular heat transfer tubes may be used as the heat transfer tubes 51, the heat transfer tubes 52, the heat transfer tubes 61, and the heat transfer tubes 62.

The distribution pipe 63 extends in a lateral direction. The distribution pipe 63 is connected to a junction pipe 54, which will be described later, in the second heat exchange unit 50. During the heating operation in which the outdoor heat exchanger 41 operates as an evaporator, the refrigerant flows into the distribution pipe 63 from the junction pipe 54 of the second heat exchange unit 50. The distribution pipe 63 distributes the refrigerant that flows therein to the heat transfer tubes 61 during the heating operation in which the outdoor heat exchanger 41 operates as an evaporator. It should be noted that the "lateral direction" used regarding the present embodiment is not limited to a horizontal direction, and the lateral direction may be inclined to the horizontal direction.

Each of the heat transfer tubes 61 extends in the upward/downward direction. Furthermore, the heat transfer tubes 61 are arranged apart from each other in the lateral direction in such a manner to extend along the air inlets when the outdoor heat exchanger 41 L-shaped as viewed in plan view is provided in the fan chamber 23. Each of the heat transfer tubes 61 includes a lower end portion connected to the distribution pipe 63. Therefore, during the heating operation in which the outdoor heat exchanger 41 operates as an evaporator, when the refrigerant is distributed from the distribution pipe 63 to the heat transfer tubes 61, the refrigerant flows into the heat transfer tubes 61 from the lower end portions of the heat transfer tubes 61, and the refrigerant flows out of upper end portions of the heat transfer tubes 61. That is, during the heating operation in which the outdoor heat exchanger 41 operates as an evaporator, the lower end portion of each of the heat transfer tubes 61 is an inflow-side end 61*a*, and the upper end of each of the heat transfer tubes 61 is an outflow-side end 61*b*. It should be noted that the "upward/downward direction" used regarding the present embodiment is not limited to a vertical direction. The upward/downward direction may be inclined to the vertical direction.

In the present embodiment, as illustrated in FIG. 9, the distribution pipe 63 includes a plurality of pipes. Specifically, the distribution pipe 63 includes an inner pipe 71 and an outer pipe 75. The inner pipe 71 is a pipe through which the refrigerant supplied to the distribution pipe 63 flows. To be more specific, the junction pipe 54, which will be described later, in the second heat exchange unit 50 communicates with the inner pipe 71, and the refrigerant flows into the inner pipe 71 from the junction pipe 54 in the second heat exchange unit 50. The inner pipe 71 includes a plurality of orifices 72 that penetrate part of the inner pipe 71. The orifices 72 have, for example, the same inside diameter, and are provided in lower part of the inner pipe 71. The outer pipe 75 is provided outward of the inner pipe 71. Thus, when flowing out of the inner pipe 71 through the orifices 72, refrigerant flows in the outer pipe 75. The lower end portions of the heat transfer tubes 61 are connected to the outer pipe 75. Thus, the refrigerant that flows in the outer pipe 75 is distributed to the heat transfer tubes 61.

Each of the heat transfer tubes 62 extends in the upward/downward direction. Further, the heat transfer tubes 62 are arranged apart from each other in the lateral direction in such a manner as to extend along the air inlets when the outdoor heat exchanger 41 L-shaped as view in plan view is provided in the fan chamber 23. The heat transfer tubes 62 and the heat transfer tubes 61 are arranged in the flow direction of air that passes through the air inlets provided in the side surfaces of the housing 21. In the present embodiment, the heat transfer tubes 62 are provided upstream of the heat transfer tubes 61 in the flow direction of air that passes through the air inlets provided in the side surfaces of the housing 21.

The connection part 65 connects the upper end portions of the heat transfer tubes 61 and the upper end portions of the heat transfer tubes 62. Therefore, during the heating operation in which the outdoor heat exchanger 41 operates as an evaporator, refrigerant that has flowed out from the upper end portions of the heat transfer tubes 61 is guided to the upper end portions of the heat transfer tubes 62 by the connection part 65. Therefore, the refrigerant flows from the upper end portion of each of the heat transfer tubes 62 into the heat transfer tube 62, and the refrigerant flows out of the lower end portion of the heat transfer tube 62. That is, during the heating operation in which the outdoor heat exchanger 41 operates as an evaporator, the upper end of the heat transfer tube 62 is an inflow-side end 62*a*, and the lower end portion of the heat transfer tube 62 is an outflow-side end 62*b*.

The junction pipe 64 extends in the lateral direction. The lower end portion of each of the heat transfer tubes 62 is connected to the junction pipe 64. During the heating operation in which the outdoor heat exchanger 41 operates as an evaporator, the refrigerant that has flowed out of the heat transfer tubes 62 join each other in the junction pipe 64.

The outflow pipe 47 is connected to the junction pipe 64. To be more specific, the outflow pipe 47 is connected to the junction pipe 64 at lower part of the junction pipe 64. In the present embodiment, the outflow pipe 47 and the junction pipe 64 are connected at an intersection between a central axis 47*a* of the outflow pipe 47 and an outer peripheral surface of the junction pipe 64. During the heating operation in which the outdoor heat exchanger 41 operates as an evaporator, the refrigerant that has flowed out the junction pipe 64 flows into the outflow pipe 47. The outflow pipe 47 is a pipe that guides the refrigerant having flowed out of the junction pipe 64 to the suction side of the compressor 2 during the heating operation in which the outdoor heat exchanger 41 operates as an evaporator. More specifically, during the heating operation in which the outdoor heat exchanger 41 operates as an evaporator, the outflow pipe 47 is connected to the suction side of the compressor 2 through the flow switching device 7 and the accumulator 10. In other words, during the heating operation in which the outdoor heat exchanger 41 operates as an evaporator, the refrigerant that has flowed into the outflow pipe 47 is sucked into the compressor 2 through the flow switching device 7 and the accumulator 10.

It should be noted that a connection position of the outflow pipe 47 to the junction pipe 64 is not limited to the lower part of the junction pipe 64.

Figure 11:
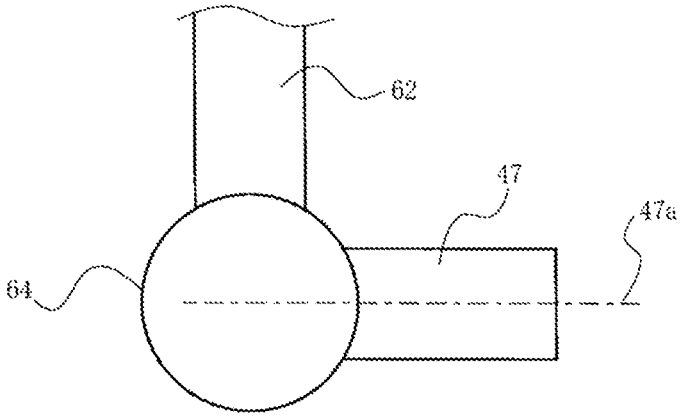
FIG. 11 is a diagram illustrating a neighboring region of a junction pipe of a second heat exchange unit in another example of the outdoor heat exchanger according to the embodiment.

FIG. 11 is a diagram illustrating a neighboring region of the junction pipe of the second heat exchange unit in another example of the outdoor heat exchanger according to the embodiment. FIG. 11 is a view as viewed in the same direction as FIG. 7. Regarding connection of the outflow pipe 47, it suffices that the outflow pipe 47 is connected to the junction pipe 64 at a center position of the junction pipe 64 or below the center positon of the junction pipe 64 in the upward/downward direction.

The second heat exchange unit 50 includes a plurality of heat transfer tubes 52 that correspond to third heat transfer tubes, a junction pipe 54 that corresponds to a second junction pipe, a plurality of heat transfer tubes 51 that correspond to fourth heat transfer tubes, a distribution pipe 53 that corresponds to a second distribution pipe, and a connection part 55 that corresponds to a second connection part.

The distribution pipe 53 extends in the lateral direction. The distribution pipe 63 is connected to an inflow pipe 45.

During the heating operation in which the outdoor heat exchanger 41 operates as an evaporator, the refrigerant flows from the inflow pipe 45 into the distribution pipe 53. The distribution pipe 53 distributes refrigerant that flows therein to the heat transfer tubes 51 during the heating operation in which the outdoor heat exchanger 41 operates as an evaporator.

Each of the heat transfer tubes 51 extends in the upward/downward direction. Furthermore, the heat transfer tubes 51 are arranged apart from each other in the lateral direction in such a manner as to extend along the air inlets when the outdoor heat exchanger 41 L-shaped as viewed in plan view is provided in the fan chamber 23. Each of the heat transfer tubes 51 has a lower end portion connected to the distribution pipe 53. Therefore, during the heating operation in which the outdoor heat exchanger 41 operates as an evaporator, when the refrigerant is distributed from the distribution pipe 53 to the heat transfer tubes 51, the refrigerant flows from the lower end portion of the heat transfer tube 51 into the heat transfer tube 51, and the refrigerant flows out of an upper end portion of the heat transfer tube 51. That is, during the heating operation in which the outdoor heat exchanger 41 operates as an evaporator, the lower end portion of the heat transfer tube 51 is an inflow-side end 51*a*, and the upper end portion of the heat transfer tube 51 is an outflow-side end 51*b*.

Each of the heat transfer tubes 52 extends in the upward/downward direction. Further, the heat transfer tubes 52 are arranged apart from each other in the lateral direction in such a manner as to extend along the air inlets when the outdoor heat exchanger 41 L-shaped as viewed in plan view is provided in the fan chamber 23. The heat transfer tubes 52 and the heat transfer tubes 51 are arranged along the flow direction of air that passes through the air inlets provided in the side surfaces of the housing 21. In the present embodiment, the heat transfer tubes 51 are disposed upstream of the heat transfer tubes 52 in the flow direction of air that passes through the air inlets provided in the side surfaces of the housing 21.

The connection part 55 connects the upper end portions of the heat transfer tubes 51 and the upper end portions of the heat transfer tubes 52. Thus, during the heating operation in which the outdoor heat exchanger 41 operates as an evaporator, refrigerant that has flowed out of the upper end portions of the heat transfer tubes 51 is guided to the upper end portions of the heat transfer tubes 52 by the connection part 55. Therefore, the refrigerant flows from the upper end portion of each of the heat transfer tubes 52 into the heat transfer tube 52, and the refrigerant flows out of the lower end portion of the heat transfer tube 52. That is, during the heating operation in which the outdoor heat exchanger 41 operates as an evaporator, the upper end portion of the heat transfer tube 52 is an inflow-side end 52*a*, and the lower end portion of the heat transfer tube 52 is an outflow-side end 52*b*.

The junction pipe 54 extends in the lateral direction. To the junction pipe 54, the lower end portions of the heat transfer tubes 52 are connected. During the heating operation in which the outdoor heat exchanger 41 operates as an evaporator, the refrigerant that has flowed out of the heat transfer tubes 52 join each other in the junction pipe 54. As described above, the junction pipe 54 is connected to the distribution pipe 63 of the first heat exchange unit 60. Therefore, during the heating operation in which the outdoor heat exchanger 41 operates as an evaporator, the refrigerant that has flowed in the second heat exchange unit 50 flows into the first heat exchange unit 60.

It should be noted that the outdoor heat exchanger 41 may include the first heat exchange unit 60 only. In this case, the inflow pipe 45 is connected to the distribution pipe 63. Furthermore, in the case where the distribution pipe 63 includes the inner pipe 71 and the outer pipe 75 as described above, the inflow pipe 45 communicates with the inner pipe 71.

Next, an operation of the air-conditioning apparatus 1 according to the present embodiment will be described.

First of all, the heating operation of the air-conditioning apparatus 1 will be described.

Figure 12:
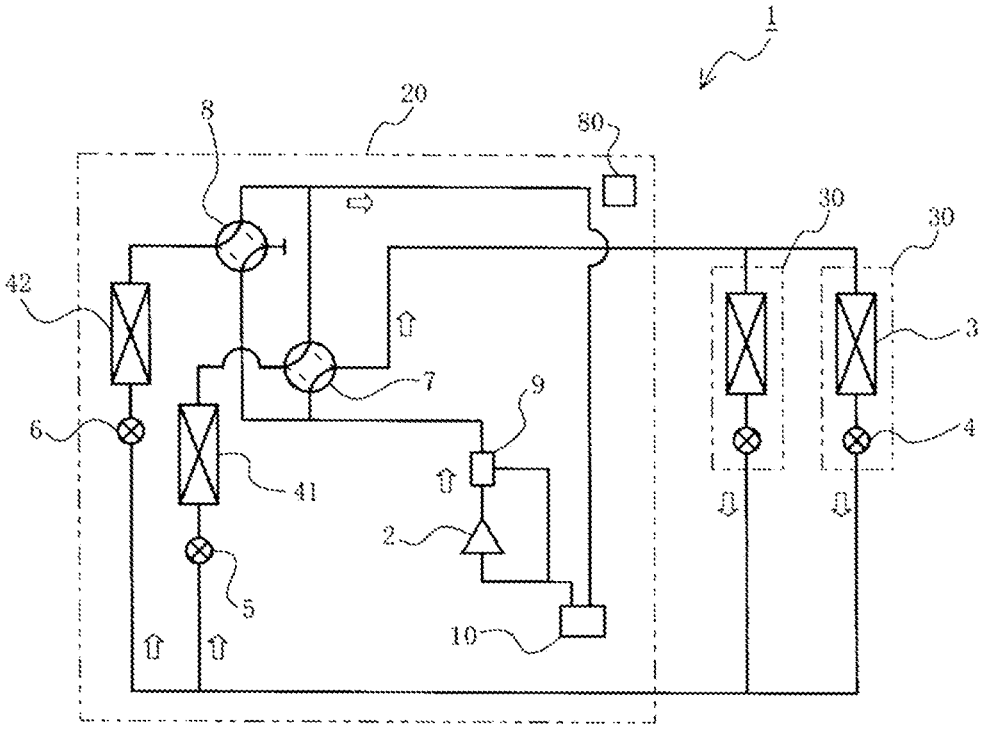
FIG. 12 is a diagram for use in explanation of a heating operation of the air-conditioning apparatus according to the embodiment.

FIG. 12 is a diagram for use in explanation of the heating operation of the air-conditioning apparatus the embodiment. It should be noted that outlined arrows in FIG. 12 indicate the flow direction of the refrigerant.

In the case where the air-conditioning apparatus 1 performs the heating operation, the controller 80 switches the flow passages of the flow switching devices 7 and 8 to flow passages indicated by solid lines in FIG. 12. As a result, the outdoor heat exchangers 41 and 42 each operate as an evaporator. After starting the compressor 2, the controller 80 controls the driving frequency of the compressor 2, the opening degrees of the expansion valves 4, the opening degree of the expansion valve 5, and the opening degree of the expansion valve 6. As a result, the heating operation of the air-conditioning apparatus 1 is started.

During the heating operation of the air-conditioning apparatus 1, high-temperature and high-pressure gas refrigerant discharged from the discharge side of the compressor 2 flows into the indoor heat exchangers 3 through the flow switching device 7. The high-temperature and high-pressure gas refrigerant that has flowed into the indoor heat exchangers 3 is cooled when heating indoor air, thereby to change into high-pressure liquid refrigerant, and the high-pressure liquid refrigerant flows out of the indoor heat exchangers 3. Part of the high-pressure liquid refrigerant that has flowed out of the indoor heat exchangers 3 flows into the outdoor heat exchanger 41 through the expansion valves 4 and the expansion valve 5. At this time, when passing through the expansion valves 4 and the expansion valve 5, the refrigerant is reduced in pressure by the expansion valves 4 and/or the expansion valve 5 to change into low-temperature and low-pressure two-phase gas-liquid refrigerant. Thus, the low-temperature and low-pressure two-phase gas-liquid refrigerant flows into the outdoor heat exchanger 41. Furthermore, remaining part of the high-pressure liquid refrigerant that has flowed out of the indoor heat exchangers 3 flows into the outdoor heat exchanger 42 through the expansion valves 4 and the expansion valve 6. At this time, when flowing through the expansion valves 4 and the expansion valve 6, the refrigerant is reduced in pressure by the expansion valves 4 and/or the expansion valve 6 to change into low-temperature and low-pressure two-phase gas-liquid refrigerant. Thus, the low-temperature and low-pressure two-phase gas-liquid refrigerant flows into the outdoor heat exchanger 42.

The low-temperature and low-pressure two-phase gas-liquid refrigerant that has flowed into the outdoor heat exchanger 41 is heated by outdoor air to evaporate and change into low-pressure gas refrigerant, and the low-pressure gas refrigerant flows out of the outdoor heat exchanger 41. The low-pressure gas refrigerant that has flowed out of the outdoor heat exchanger 41 passes through the flow switching device 7. Furthermore, the low-temperature and low-pressure two-phase gas-liquid refrigerant that has flowed into the outdoor heat exchanger 42 is heated by outdoor air to evaporate and change into low-pressure gas refrigerant, and the low-pressure gas refrigerant flows out of the outdoor heat exchanger 42. The low-pressure gas refrigerant that has flowed out of the outdoor heat exchanger 42 passes through the flow switching device 8. The low-pressure gas refrigerant that has passed through the flow switching device 7 and the low-pressure gas refrigerant that has passed through the flow switching device 8 join each other to combine into single low-pressure gas refrigerant, and the low-pressure gas refrigerant passes through the accumulator 10 and is then sucked into the compressor 2 from the suction side of the compressor 2. The low-pressure gas refrigerant that has sucked into the compressor 2 is compressed by the compressor 2 into high-temperature and high-pressure gas refrigerant, and the high-temperature and high-pressure gas refrigerant is discharged from the discharge side of the compressor 2.

The controller 80 controls the driving frequency of the compressor 2 based on a heating load that is borne by the air-conditioning apparatus 1, and adjusts a heating capacity of the air-conditioning apparatus 1. Therefore, in the case where the operation of the indoor unit 30 or indoor units 30 is stopped, when the heating load that is borne by the air-conditioning apparatus 1 is reduced, the controller 80 reduces the driving frequency of the compressor 2. In this case, in an existing air-conditioning apparatus, in the case where the heating capacity of the air-conditioning apparatus is increased for the heating load that is borne by the air-conditioning apparatus, even when the driving frequency of the compressor is reduced to the lowest frequency, the controller stops the compressor once. Furthermore, the controller adjusts the heating capacity of the air-conditioning apparatus such that the heating capacity reaches a heating capacity corresponding to the heating load, by repeating starting and stop of the compressor. In such a control method, however, temperature unevenness in an indoor space is increased, thus causing a person in the indoor space to feel uncomfortable. Therefore, in the case where the air-conditioning apparatus according to the embodiment is put into a low heating load state where starting and stop of the compressor are repeated in the existing air-conditioning apparatus, the air-conditioning apparatus 1 according to the embodiment operates in the following manner.

As described above, the air-conditioning apparatus 1 according to the present embodiment includes a plurality of sets of flow switching devices, outdoor heat exchangers, and expansion valves that are provided such that the flow switching device, the outdoor heat exchanger and the expansion valve of each of the plurality of sets are connected in series, and in the plurality of sets, the flow switching devices are connected in parallel, the outdoor heat exchangers are connected in parallel, and the expansion valves are connected in parallel. Therefore, the air-conditioning apparatus 1 causes at least one of the outdoor heat exchangers not to operate as an evaporator and causes the refrigerant to flow through the at least one outdoor heat exchanger that does not operate as an evaporator, thereby to reduce repetition of starting and stop of the compressor 2 in the low heating load state. Then, the operation of the air-conditioning apparatus 1 that is in the low heating load state will be specifically described. It should be noted that in the following, in the case where at least one of the outdoor heat exchangers operates as an evaporator, an outdoor heat exchanger or exchangers that do not operate as evaporators will be referred to as a first resting outdoor heat exchanger or exchangers. Furthermore, in the following, the operation of the air-conditioning apparatus 1 that is in the low heating load state is described by referring to by way of example the case where the outdoor heat exchanger 41 operates as an evaporator and the outdoor heat exchanger 42 operates as the first resting outdoor heat exchanger.

Figure 13:
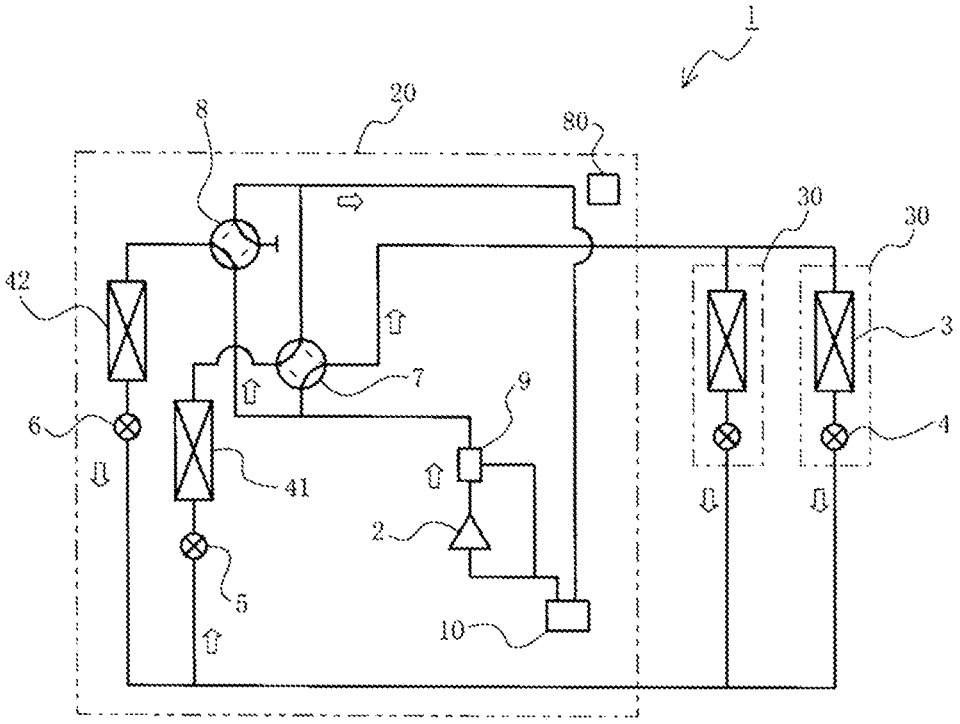
FIG. 13 is a diagram for use in explanation of the heating operation of the air-conditioning apparatus that is in a low heating load state.

FIG. 13 is a diagram for use in explanation of the heating operation of the air-conditioning apparatus according to the embodiment that is in the low heating load state. Outlined arrows in FIG. 13 indicate the flow direction of the refrigerant.

In the low heating load state, the controller 80 switches the flow passage of the flow switching device 8 connected to the outdoor heat exchanger 42 that is the first resting outdoor heat exchanger, to a flow passage indicated by a solid line in FIG. 13. More specifically, the controller 80 switches the flow passage of the flow switching device 8 to a flow passage that causes the discharge side of the compressor 2 and the outdoor heat exchanger 42 to communicate with each other. Furthermore, in the low heating load state, the controller 80 controls the opening degree of the expansion valve 6 connected to the outdoor heat exchanger 42 that is the first resting outdoor heat exchanger, to thereby adjust the flow rate of refrigerant that flows in the outdoor heat exchanger 42. That is, when the air-conditioning apparatus 1 is put into the low heating load state, the flow switching device 8 causes the discharge side of the compressor 2 and the outdoor heat exchanger 42 to communicate with each other, and the expansion valve 6 adjusts the flow rate of the refrigerant that flows in the outdoor heat exchanger 42.

When the air-conditioning apparatus 1 is put into such a state as described above, part of the high-temperature and high-pressure gas refrigerant discharged from the discharge side of the compressor 2 flows into a flow passage between each of the expansion valves 4 and the expansion valve 5 through the flow switching device 8, the outdoor heat exchanger 42, and the expansion valve 6. That is, part of the high-temperature and high-pressure gas refrigerant discharged from the discharge side of the compressor 2 can bypass the indoor heat exchangers 3. Furthermore, the opening degree of the expansion valve 6 is controlled to adjust the flow rate of the refrigerant that flows in the outdoor heat exchanger 42, whereby it is also possible to adjust the amount of the refrigerant that flows in each of the indoor heat exchangers 3. Thus, even when being in the low heating load state, the air-conditioning apparatus 1 can has a heating capacity corresponding to the heating load without stopping the compressor 2. Therefore, in the air-conditioning apparatus 1, it is possible to reduce repetition of starting and stop of the compressor 2 in the low heating load state.

Next, the cooling operation of the air-conditioning apparatus 1 will be described.

Figure 14:
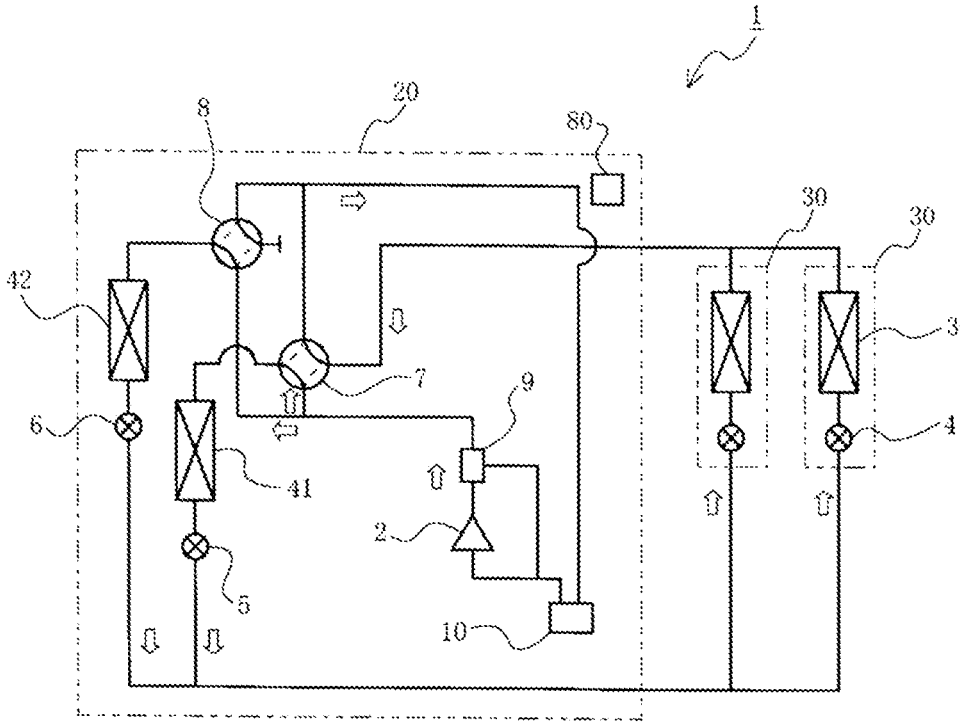
FIG. 14 is a diagram for use in explanation of a cooling operation of the air-conditioning apparatus according to the embodiment.

FIG. 14 is a diagram for use in explanation of the cooling operation of the air-conditioning apparatus according to the embodiment. Outlined arrows in FIG. 14 indicate the flow direction of the refrigerant.

In the case where the air-conditioning apparatus 1 performs the cooling operation, the controller 80 switches the flow passages of the flow switching devices 7 and 8 to flow passages indicated by solid lines in FIG. 14. As a result, the outdoor heat exchangers 41 and 42 each operate as a condenser. After starting the compressor 2, the controller 80 controls the driving frequency of the compressor 2, the opening degrees of the expansion valves 4, the opening degree of the expansion valve 5, and the opening degree of the expansion valve 6. As a result, the cooling operation of the air-conditioning apparatus 1 is started.

During the cooling operation of the air-conditioning apparatus 1, part of the high-temperature and high-pressure gas refrigerant discharged from the discharge side of the compressor 2 flows into the outdoor heat exchanger 41 through the flow switching device 7. Remaining part of the high-temperature and high-pressure gas refrigerant discharged from the discharge side of the compressor 2 flows into the outdoor heat exchanger 42 through the flow switching device 8. The high-temperature and high-pressure gas refrigerant that has flowed into the outdoor heat exchanger 41 is cooled by outdoor air to condense and change into high-pressure liquid refrigerant, and the high-pressure liquid refrigerant flows out of the outdoor heat exchanger 41. The refrigerant that has flowed out of the outdoor heat exchanger 41 passes through the expansion valve 5. The high-temperature and high-pressure gas refrigerant that has flowed into the outdoor heat exchanger 42 is also cooled by outdoor air to condense and change into high-pressure liquid refrigerant, and the high-pressure liquid refrigerant flows out of the outdoor heat exchanger 42. The refrigerant that has flowed out of the outdoor heat exchanger 42 passes through the expansion valve 6. The high-pressure liquid refrigerant that has passed through the expansion valve 5 and the high-pressure liquid refrigerant that has passed through the expansion valve 6 flow into the indoor heat exchangers 3 through the expansion valves 4. At this time, the high-pressure liquid refrigerant that has flowed out of the outdoor heat exchanger 41 is reduced in pressure by the expansion valves 4 and/or the expansion valve 5 to change into low-temperature and low-pressure two-phase gas-liquid refrigerant. Furthermore, the high-pressure liquid refrigerant that has flowed out of the outdoor heat exchanger 42 is reduced in pressure by the expansion valve 6 and/or the expansion valves 4 to change into low-temperature and low-pressure two-phase gas-liquid refrigerant. Thus, the low-temperature and low-pressure two-phase gas-liquid refrigerant flows into each of the indoor heat exchangers 3.

When cooling indoor air, the low-temperature and low-pressure two-phase gas-liquid refrigerant that has flowed into each of the indoor heat exchangers 3 is heated to change into low-pressure gas refrigerant, and the low-pressure gas refrigerant flows out of each of the indoor heat exchangers 3. The low-pressure gas refrigerant that has flowed out of each of the indoor heat exchangers 3 passes through the flow switching device 7 and the accumulator 10, and is sucked from the suction side of the compressor 2 into the compressor 2. The low-pressure gas refrigerant that has sucked into the compressor 2 is compressed by the compressor 2 to change into high-temperature and high-pressure gas refrigerant, and the high-temperature and high-pressure gas refrigerant is discharged from the discharge side of the compressor 2.

The controller 80 controls the driving frequency of the compressor 2 based on a cooling load that is borne by the air-conditioning apparatus 1, and adjusts the cooling capacity of the air-conditioning apparatus 1. Therefore, in the case where the cooling load that is borne by the air-conditioning apparatus 1 is reduced, for example, in the case where the operation of the indoor unit 30 or indoor units 30 is stopped, the controller 80 reduces the driving frequency of the compressor 2. In this case, in the existing air-conditioning apparatus, in the case where the cooling capacity of the air-conditioning apparatus is larger than the cooling load that is borne by the air-conditioning apparatus even after the driving frequency of the compressor is reduced to the lowest frequency, the controller stops the compressor once. Furthermore, the controller adjusts the cooling capacity of the air-conditioning apparatus such that the cooling capacity corresponds to the cooling load, by repeating starting and stop of the compressor. However, in such a control method, temperature unevenness in the indoor space is increased, and a person who is present in the indoor space feels uncomfortable. Therefore, in a low cooling load state where starting and stop of the compressor are repeated in the existing air-conditioning apparatus, the air-conditioning apparatus 1 according to the present embodiment operates in the following manner.

As described above, the air-conditioning apparatus 1 according to the present embodiment includes a plurality of sets of flow switching devices, outdoor heat exchangers, and expansion valves. The plurality of sets of flow switching devices, outdoor heat exchangers, and expansion valves are connected in parallel, and the flow switching device, the outdoor heat exchanger and the expansion valve of each of the plurality of sets are connected in series. Therefore, the air-conditioning apparatus 1 can reduce repetition of starting and stop of the compressor 2 in the low cooling load state by causing at least one of the outdoor heat exchangers not to operate as a condenser and causing the refrigerant to flow in at least one outdoor heat exchanger that does not operate as a condenser. The operation of the air-conditioning apparatus 1 that is in the low cooling load state will be specifically described. It should be noted that in the following, in the case where at least one of the outdoor heat exchangers operates as a condenser, an outdoor heat exchanger or exchangers not operating as condensers will be referred to as a second resting outdoor heat exchanger or exchangers. Furthermore, in the following, the operation of the air-conditioning apparatus 1 that is in the low cooling load state is described by referring to by way of example the case where the outdoor heat exchanger 41 operates as a condenser and the outdoor heat exchanger 42 is the second resting outdoor heat exchanger.

Figure 15:
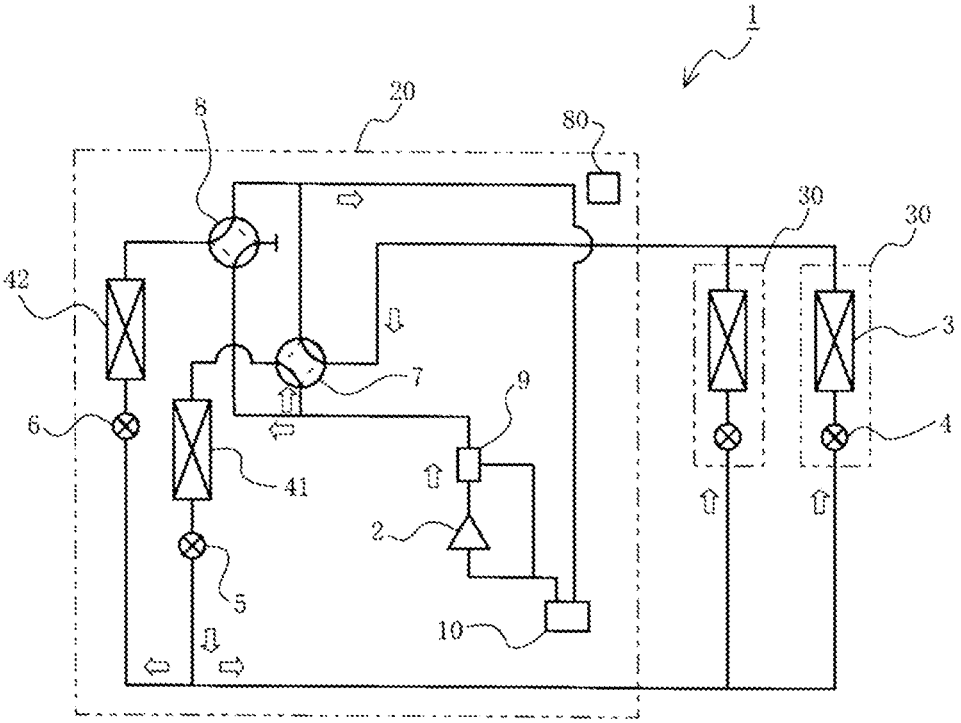
FIG. 15 is a diagram for use in explanation of the cooling operation of the air-conditioning apparatus according to the embodiment that is in the low cooling load state.

FIG. 15 is a diagram for use in explanation of the cooling operation of the air-conditioning apparatus according to the embodiment that is in the low cooling load state. Outlined arrows in FIG. 15 indicate the flow direction of the refrigerant.

In the low cooling load state, the controller 80 switches the flow passage of the flow switching device 8 connected to the outdoor heat exchanger 42 that is the second resting outdoor heat exchanger, to a flow passage indicated by a solid line in FIG. 15. More specifically, the controller 80 switches the flow passage of the flow switching device 8 to a flow passage that causes the suction side of the compressor 2 and the outdoor heat exchanger 42 to communicate with each other. Furthermore, in the low cooling load state, the controller 80 controls the opening degree of the expansion valve 6 connected to the outdoor heat exchanger 42 that is the second resting outdoor heat exchanger, to thereby adjust the flow rate of the refrigerant that flows through the outdoor heat exchanger 42. That is, in the low cooling load state, in the air-conditioning apparatus 1, the flow switching device 8 causes the suction side of the compressor 2 and the outdoor heat exchanger 42 to communicate with each other, and the expansion valve 6 adjusts the flow rate of the refrigerant that flows in the outdoor heat exchanger 42.

When the air-conditioning apparatus 1 is put into such a state as described above, the high-temperature and high-pressure gas refrigerant discharged from the discharge side of the compressor 2 flows into the outdoor heat exchanger 41 through the flow switching device 7. The high-temperature and high-pressure gas refrigerant that has flowed into the outdoor heat exchanger 41 is cooled by outdoor air to condense and change into high-pressure liquid refrigerant, and the high-pressure liquid refrigerant flows out of the outdoor heat exchanger 41. Part of the high-pressure liquid refrigerant that has flowed out of the outdoor heat exchanger 41 flows toward the indoor heat exchangers 3 in a manner similar to that in the cooling operation described with reference to FIG. 14. In contrast, remaining part of the high-pressure liquid refrigerant that has flowed out of the outdoor heat exchanger 41 flows into a flow passage between each of the indoor heat exchangers 3 and the suction side of the compressor 2 through the expansion valve 6, the outdoor heat exchanger 42, and the flow switching device 8. That is, part of the high-pressure liquid refrigerant that has flowed out of the outdoor heat exchanger 41 can bypass the indoor heat exchangers 3. Furthermore, the opening degree of the expansion valve 6 is controlled to adjust the flow rate of refrigerant that flows through the outdoor heat exchanger 42, whereby it is also possible to adjust the amount of refrigerant that flows in each of the indoor heat exchangers 3. Thus, even when being in the low cooling load state, the air-conditioning apparatus 1 can have a cooling capacity corresponding to the cooling load without stopping the compressor 2. Therefore, the air-conditioning apparatus 1 can reduce repetition of stating and stop of the compressor 2 in the low cooling load state.

Next, the flow of refrigerant in each of the outdoor heat exchangers of the air-conditioning apparatus 1 will be described. In the following, the flow of the refrigerant in the outdoor heat exchanger of the air-conditioning apparatus 1 is described by referring to by way of example the outdoor heat exchanger 41 that is one of the outdoor heat exchangers of the air-conditioning apparatus 1, with reference to FIGS. 5 to 9.

During the heating operation in which the outdoor heat exchanger 41 operates as an evaporator, the refrigerant flows in the following manner.

Liquid refrigerant obtained as a result of condensing at each of the indoor heat exchangers 3 is expanded by at least one of the expansion valves 4 and 5 to change into two-phase gas-liquid refrigerant, and the two-phase gas-liquid refrigerant flows into the inflow pipe 45. The two-phase gas-liquid refrigerant that has flowed into the inflow pipe 45 flows into the distribution pipe 53. Then, the two-phase gas-liquid refrigerant that has flowed into the distribution pipe 53 is distributed to the heat transfer tubes 51 of the second heat exchange unit 50.

In the existing outdoor heat exchanger including the plurality of heat transfer tubes, the distribution pipe, and the junction pipe, the distribution pipe extends in the upward/downward direction. Furthermore, the heat transfer tubes connected to the distribution pipe are arranged apart from each other in the upward/downward direction. That is, in the existing outdoor heat exchanger including the heat transfer tubes, the distribution pipe, and the junction pipe, the two-phase gas-liquid refrigerant that flows in the distribution pipe in the upward/downward direction is distributed to the heat transfer tubes. The liquid refrigerant that has higher specific gravity than the specific gravity of the gas refrigerant does not easily flow upward in the distribution pipe because of the effect of the gravity. Therefore, in the existing outdoor heat exchanger including the heat transfer tubes, the distribution pipe, and the junction pipe, the higher the position of a heat transfer tube, the smaller the amount of liquid refrigerant reaching the heat transfer tube; that is, it is harder to uniformly distribute the two-phase gas-liquid refrigerant to the heat transfer tubes, for example. As a result, the heat exchange capability of the existing outdoor heat exchanger including the heat transfer tubes, the distribution pipe, and the junction pipe is lowered.

In contrast, the distribution pipe 53 according to the present embodiment extends in the lateral direction, and distributes the two-phase gas-liquid refrigerant that flows in the lateral direction to the heat transfer tubes 51. Thus, the distribution pipe 53 can uniformly distribute the two-phase gas-liquid refrigerant to the heat transfer tubes 51, as compared with the existing distribution pipe. Therefore, as compared with the existing outdoor heat exchanger including the heat transfer tubes, the distribution pipe, and the junction pipe, the outdoor heat exchanger 41 according to the present embodiment can reduce lowering of the heat exchange capability.

The two-phase gas-liquid refrigerant that has flowed into the heat transfer tubes 51 flows through the heat transfer tubes 51 while exchanging heat with outdoor air, and flows into the heat transfer tubes 52 through the connection part 55. The two-phase gas-liquid refrigerant that has flowed into the heat transfer tubes 52 flows through the heat transfer tubes 52 while exchanging heat with outdoor air, and flows out of the heat transfer tubes 52. The refrigerant that has flowed out of the heat transfer tubes 52 joins each other in the junction pipe 54. It should be noted that in the present embodiment, the controller 80 controls the opening degree of the expansion valve 5, etc., to cause the refrigerant that flows out of the heat transfer tubers 52 to change into two-phase gas liquid refrigerant, and also to cause the refrigerant that flows out of the heat transfer tubes 62 of the first heat exchange unit 60 to change into gas refrigerant.

The two-phase gas-liquid refrigerant that has joined each other in the junction pipe 54 flows into the distribution pipe 63 of the first heat exchange unit 60. Thereafter, the two-phase gas-liquid refrigerant that has flowed into the distribution pipe 63 is distributed to the heat transfer tubes 61. The distribution pipe 63, as well as the distribution pipe 53, extends in the lateral direction, and distributes the two-phase gas-liquid refrigerant that flows in the lateral direction to the heat transfer tubes 61. Thus, the distribution pipe 63 can uniformly distribute the two-phase gas-liquid refrigerant to the heat transfer tubes 61, as compared with the existing distribution pipe. Therefore, as compared with the existing outdoor heat exchanger including the heat transfer tubes, the distribution pipe, and the junction pipe, the outdoor heat exchanger 41 according to the present embodiment can reduce lowering of the heat exchange capacity.

In the case where the distribution pipe 63 is formed of a single pipe, the two-phase gas-liquid refrigerant that flows in the distribution pipe 63 in the lateral direction flows into the heat transfer tubes 61 in turn from a heat transfer tube 61 located on an upstream side to a heat transfer tube 61 located on a downstream side. At this time, the two-phase gas-liquid refrigerant distributed to the heat transfer tubes 61 can be considered to become nonuniform due to a pressure loss that occurs when the two-phase gas-liquid refrigerant flows into the heat transfer tubes 61. In particular, in the case where the heat transfer tubes 61 are flat tubes as in the present embodiment, the larger the number of refrigerant flow passages 43*a*, the thinner the refrigerant flow passages 43*a*. Therefore, the two-phase gas-liquid refrigerant distributed to the heat transfer tubes 61 easily becomes nonuniform.

However, in the present embodiment, the distribution pipe 63 includes the inner pipe 71 and the outer pipe 75 as described above. In the distribution pipe 63 having such a configuration, when the two-phase gas-liquid refrigerant flows out of the inner pipe 71 through the orifices 72, liquid refrigerant and gas refrigerant of the two-phase gas-liquid refrigerant are agitated in the outer pipe 75. Thereafter, the agitated two-phase gas-liquid refrigerant is distributed to the heat transfer tubes 61. Therefore, because the distribution pipe 63 is configured as described regarding the present embodiment, it is possible to reduce nonuniformity of the two-phase gas-liquid refrigerant distributed to the heat transfer tubes 61 that would be caused by a pressure loss that occurs when the two-phase gas-liquid refrigerant flows into the heat transfer tubes 61. Thus, the outdoor heat exchanger 41 according to the present embodiment can further reduce lowering of the heat exchange capability. It should be noted that the configuration of the distribution pipe 63 including the inner pipe 71 and the outer pipe 75 is not limited to the configuration as illustrated in FIG. 9. Some modifications of the distribution pipe 63 including the inner pipe 71 and the outer pipe 75 will be described below.

Figure 16:
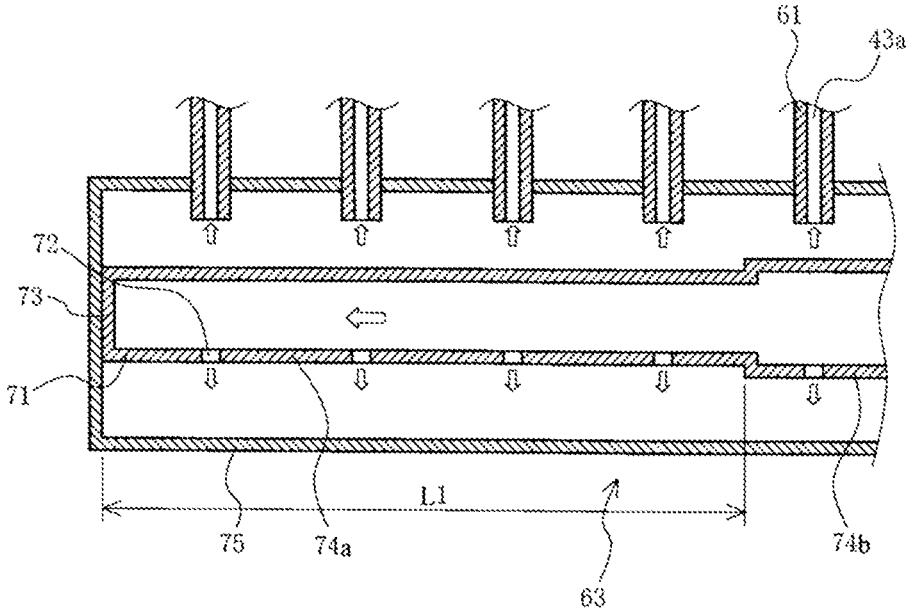
FIG. 16 is a diagram illustrating a modification of a distribution pipe of the outdoor heat exchanger in the air-conditioning apparatus according to the embodiment.

FIG. 16 is a diagram illustrating a modification of the distribution pipe of the outdoor heat exchanger in the air-conditioning apparatus according to the embodiment. FIG. 16 is a vertical sectional view of the modification of the distribution pipe 63 including the inner pipe 71 and the outer pipe 75. Outlined arrows in FIG. 16 indicate the flow direction of refrigerant that flows in the distribution pipe 63 when the outdoor heat exchanger 41 operates as an evaporator.

As illustrated in FIG. 16, in the inner pipe 71, an end 73, a first range 74*a*, and a second range 74*b* are defined as follows. The end 73 is an end of the inner pipe 71 that is located on the downstream side in the flow direction of refrigerant that flows in the inner pipe 71 when the outdoor heat exchanger 41 operates as an evaporator. The first range 74*a* is a range from the end 73 to a location that is separated from the end 73 by a predetermined distance L1. The second range 74*b* is a range that is located upstream of the first range 74*a* in the flow direction of the refrigerant that flows in the inner pipe 71 when the outdoor heat exchanger 41 operates as an evaporator. In the case where the end 73, the first range 74*a*, and the second range 74*b* are defined as described above, the inside diameter of part of the inner pipe 71 that is located in the first range 74*a* is smaller than the inside diameter of part of the inner pipe 71 that is located in the second range 74*b* as illustrated in FIG. 16.

When the outdoor heat exchanger 41 operates as an evaporator, part of the two-phase gas-liquid refrigerant that has flowed into the inner pipe 71 flows out through the orifices, while the two-phase gas-liquid refrigerant is flowing toward the end 73. Therefore, the speed of the two-phase gas-liquid refrigerant that flows through the inner pipe 71 is reduced as the two-phase gas-liquid refrigerant approaches the end 73. Therefore, in order that the refrigerant be uniformly distributed from the inner pipe 71 to the outer pipe 75, it is preferable that a flow regime of the two-phase gas-liquid refrigerant in the inner pipe 71 be an annular flow. However, when the speed of the two-phase gas-liquid refrigerant flowing in the inner pipe 71 is reduced, the flow regime of the two-phase gas-liquid refrigerant in the inner pipe 71 may be changed from the annular flow to a separated flow. In the case where the flow regime is the separated flow, the liquid refrigerant flows downwards due to gravity, and a large amount of liquid refrigerant flows in a lower region in the inner pipe 71. Therefore, in a range where the flow regime of the two-phase gas-liquid refrigerant in the inner pipe 71 is the separated flow, in some cases, a larger amount of liquid refrigerant than expected flows out through some of the orifices 72. For example, in the range where the flow regime of the two-phase gas-liquid refrigerant in the inner pipe 71 is the separated flow, in some cases, a larger amount of liquid refrigerant than expected flows out through an orifice 72 located on the most upstream side in the flow direction of the refrigerant. In such a state, distribution of the refrigerant to the heat transfer tubes 61 may become nonuniform.

In the inner pipe 71 as illustrated in FIG. 16, however, the inside diameter of part of the inner pipe that is located in the first range 74*a* and where the flow speed of the two-phase gas-liquid refrigerant is easily reduced is made smaller than the inside diameter of part of the inner pipe 71 that is located the second range 74*b*. That is, in the inner pipe 71 as illustrated in FIG. 16, as compared with an inner pipe 71 whose inside diameter is constant throughout the inner pipe 71, it is possible to increase the flow speed of the two-phase gas-liquid refrigerant by reduction of the inside diameter in the first range 74*a* where the flow speed of the two-phase gas-liquid refrigerant is easily reduced. That is, since the inner pipe 71 is configured as illustrated in FIG. 16, it is possible to prevent the flow regime of the two-phase gas-liquid refrigerant in the inner pipe 71 from becoming the separated flow, and to prevent a larger amount liquid refrigerant than expected from flowing out through the orifices 72. Therefore, because the inner pipe 71 is configured as illustrated in FIG. 16, it is possible to reduce nonuniformity of distribution of the refrigerant to the heat transfer tubes 61.

Figure 17:
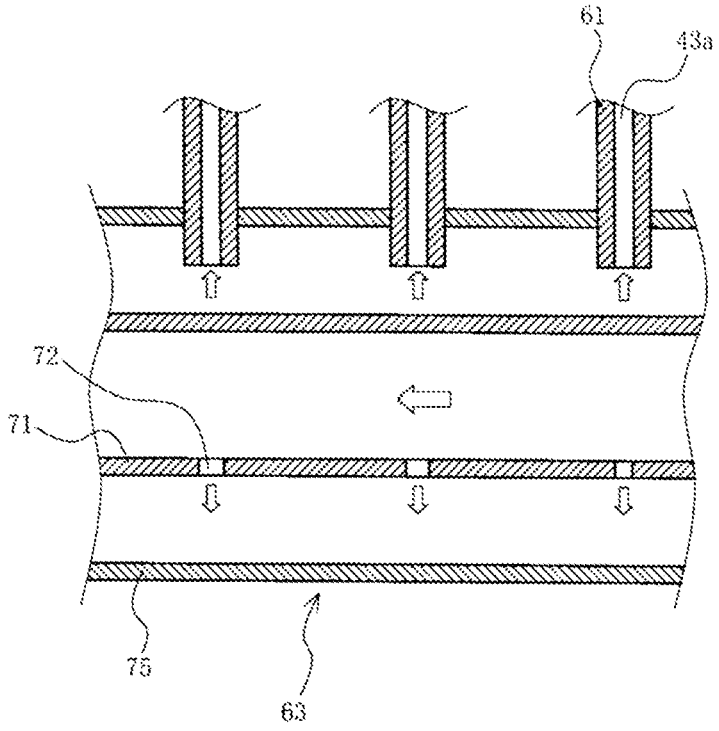
FIG. 17 is a diagram illustrating another modification of the distribution pipe of the outdoor heat exchanger in the air-conditioning apparatus according to the embodiment.

FIG. 17 is a diagram illustrating another modification of the distribution pipe of the outdoor heat exchanger of the air-conditioning apparatus according to the embodiment. FIG. 17 is a vertical sectional view of another modification of the distribution pipe 63 including the inner pipe 71 and the outer pipe 75. Outlined arrows in FIG. 17 indicate the flow direction of refrigerant that flows in the distribution pipe 63 when the outdoor heat exchanger 41 operates as an evaporator.

As described above, in the range where the flow regime of the two-phase gas-liquid refrigerant in the inner pipe 71 is the separated flow, a larger amount of liquid refrigerant than expected may flow out through some of the orifices 72. In view of this, regarding the inner pipe 71 as illustrated in FIG. 17, amounts of liquid refrigerant that flows out through of orifices 72 in the case where the orifices 72 are made to have the same inside diameter are measured, and then based on the measured amounts of the liquid refrigerant that flow out through the orifices 72, the inside diameter of each of the orifices 72 of the present embodiment is determined. To be more specific, in the case where orifices 72 are made to have the same inside diameter, it is determined which of the orifices 72 is an orifice from which a large amount of liquid refrigerant flows out. In the present embodiment, an orifice 72 corresponding to the above orifice from which a large amount of liquid refrigerant flows out is made smaller than diameters of the other orifices 72. That is, in the inner pipe 71 as illustrated in FIG. 17, the orifices 72 do not have the same diameters. More specifically, of the orifices 72, an arbitrary orifice 72 is a first orifice, and the orifices 72 other than the first orifice are second orifices. In this case, in the inner pipe 71 as illustrated in FIG. 17, the inside diameter of at least one of the second orifices is different from the inside diameter of the first orifice.

Since the inner pipe 71 is configured as illustrated in FIG. 17, even in the case where the flow regime of the two-phase gas-liquid refrigerant in the inner pipe 71 is the separated flow, it is possible to reduce the degree to which the amounts of liquid refrigerant that flows out through the orifices 72 becomes nonuniform. Therefore, because the inner pipe 71 is configured as illustrated in FIG. 17, even in the case where the flow regime of the two-phase gas-liquid refrigerant in the inner pipe 71 is the separated flow, it is possible to further reduce the degree to which distribution of the refrigerant to the heat transfer tubes 61 is nonuniform. It should be noted that in the inner pipe 71 whose inside diameter varies as illustrated in FIG. 16, the orifices 72 may be made to have different inside diameters as illustrated in FIG. 17. This is because even in the case of the inner pipe 71 whose inside diameter varies as illustrated in FIG. 16, the flow regime of the two-phase gas-liquid refrigerant in the inner pipe 71 may become the separated flow under a given operation condition of the air-conditioning apparatus 1.

Figure 18:
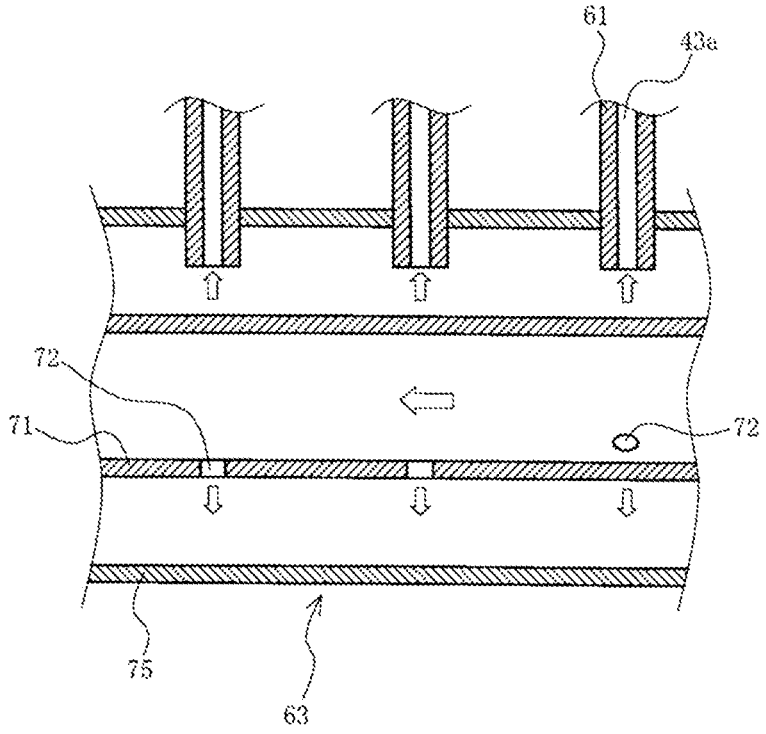
FIG. 18 is a diagram illustrating a further modification of the distribution pipe of the outdoor heat exchanger in the air-conditioning apparatus according to the embodiment.

FIG. 18 is a diagram illustrating a further modification of the distribution pipe of the outdoor heat exchanger of the air-conditioning apparatus according to the embodiment. FIG. 18 is a vertical sectional view of the further modification of the distribution pipe 63 including the inner pipe 71 and the outer pipe 75. Outlined arrows in FIG. 18 indicate the flow direction of refrigerant that flows in the distribution pipe 63 when the outdoor heat exchanger 41 operates as an evaporator.

As described above, in the range where the flow regime of the two-phase gas-liquid refrigerant in the inner pipe 71 is the separated flow, a large amount of liquid refrigerant flows through the lower region in the inner pipe 71. Therefore, the amount of liquid refrigerant that flows out through each orifice 72 can be adjusted by adjusting the level of the position of the orifice 72. In view of this, regarding the inner pipe 71 illustrated in FIG. 18, amounts of liquid refrigerant that flow out through orifices 72 in the case where the orifices 72 are provided at the same level are measured, and based on the measured amounts of the liquid refrigerant that flows out through the orifices 72, the levels of the positions of the orifices 72 of the present embodiment are determined. More specifically, it is determined which of the orifices 72 is an orifice from which a large amount of liquid refrigerant flows out in the case where the orifices 72 are provided at the same level. In the present embodiment, an orifice 72 corresponding to the above orifice from which a large amount of liquid refrigerant flows is provided at a higher level than those of the other orifices 72. That is, in the inner pipe 71 as illustrated in FIG. 18, the orifices 72 are not provided at the same level. More specifically, of the orifices 72, an arbitrary orifice 72 is a third orifice, and the orifices 72 other than the third orifice are fourth orifices. In this case, in the inner pipe 71 as illustrated in FIG. 18, the level of the position of at least one of the fourth orifices is different from that of the third orifice in the upward/downward direction.

Even in the case where the flow regime of the two-phase gas-liquid refrigerant in the inner pipe 71 is the separated flow, since the inner pipe 71 is configured as illustrated in FIG. 18, it is possible to reduce the degree to which the amounts of liquid refrigerant flowing out through the orifices 72 are nonuniform. Therefore, even in the case where the flow regime of the two-phase gas-liquid refrigerant in the inner pipe 71 is the separated flow, in the inner pipe 71 that is configured as illustrated in FIG. 18, it is possible to further reduce the degree to which distribution of the refrigerant to the heat transfer tubes 61 is nonuniform. It should be noted that in the inner pipe 71 whose inside diameter varies as illustrated in FIG. 16, the orifices 72 may be provided at different levels as illustrated in FIG. 18. This is because the flow regime of the two-phase gas-liquid refrigerant in the inner pipe 71 may become the separated flow even in the inner pipe 71 whose inside diameter varies as illustrated in FIG. 16, under a given operation condition of the air-conditioning apparatus 1. In addition, the orifices 72 may be provided at different levels as illustrated in FIG. 18, and may be made to have different inside diameters as illustrated in FIG. 17.

The flow of the refrigerant in the case where the outdoor heat exchanger 41 operates as an evaporator will be re-described. When flowing into the heat transfer tubes 61, the two-phase gas-liquid refrigerant flows through the heat transfer tubes 61 while exchanging heat with outdoor air, and flows into the heat transfer tubes 62 through the connection part 65. When flowing into the heat transfer tubes 62, the two-phase gas-liquid refrigerant flows through the heat transfer tubes 62 while exchanging heat with outdoor air to change into gas refrigerant, and the gas refrigerant flows out of the heat transfer tubes 62. The refrigerant that has flowed out of the heat transfer tubes 62 join each other in the junction pipe 64. Thereafter, the refrigerant that has joined each other in the junction pipe 64 flows into the outflow pipe 47 and is guided to the suction side of the compressor 2.

In the compressor 2, the refrigerating machine oil is stored in order to lubricate a sliding portion of the inside the compressor 2 and to seal a gap in a compression mechanism unit, and for other purposes. When the compressor 2 compresses the refrigerant and discharges the compressed refrigerant, part of the refrigerating machine oil in the compressor 2 flows out of the compressor 2 with the compressed refrigerant. The refrigerating machine oil that has flowed out of the compressor 2 circulates in the refrigeration cycle circuit, and returns to the compressor 2. Therefore, during the heating operation in which the outdoor heat exchanger 41 operates as an evaporator, the refrigerating machine oil that has flowed out of the compressor 2 flows from the heat transfer tubes 62 into the junction pipe 64 and joins each other, and the resultant refrigerating machine oil returns to the compressor 2 through the outflow pipe 47.

In the existing outdoor heat exchanger including the heat transfer tubes, the distribution pipe, and the junction pipe, the junction pipe extends in the upward/downward direction. Therefore, the refrigerating machine oil in the junction pipe is easily collected at a lower end portion of the junction pipe because of the effect of gravity. Therefore, in some cases, in an air-conditioning apparatus employing the existing outdoor heat exchanger that includes the heat transfer tubes, the distribution pipe, and the junction pipe, during the heating operation in which the outdoor heat exchanger operates as an evaporator, the refrigerating machine oil is collected at the lower end portion of the junction pipe, and the compressor thus runs short of refrigerating machine oil, as a result of which the reliability of the air-conditioning apparatus lowers.

In contrast, in the air-conditioning apparatus 1 according to the present embodiment, the junction pipe 64 extends in the lateral direction. Furthermore, the outflow pipe 47 is connected to the junction pipe 64 at or below the center position of the junction pipe 64 in the upward/downward direction. Therefore, in the air-conditioning apparatus 1 according to the present embodiment, even in the case where the refrigerating machine oil is collected at the lower part of the junction pipe 64 because of the effect of gravity, the refrigerating machine oil easily flows into the outflow pipe 47. In other words, in the air-conditioning apparatus 1 according to the present embodiment, it is possible to reduce collection of the refrigerating machine oil at part of the junction pipe 64 where the refrigerating machine oil does not easily flow out of the outflow pipe 47. Therefore, the air-conditioning apparatus 1 according to the present embodiment can reduce shortage of the refrigerating machine oil in the compressor 2, and to reduce lowering of the reliability of the air-conditioning apparatus 1. In the embodiment, the outflow pipe 47 is connected to the junction pipe 64 at the lower part of the junction pipe 64. This connection position is a position where the refrigerating machine oil most easily flows to the outflow pipe 47 when the refrigerating machine oil is collected at the lower part of the junction pipe 64. Therefore, since the outflow pipe 47 and the junction pipe 64 are connected at the lower part of the junction pipe 64, it is possible to further reduce shortage of the refrigerating machine oil in the compressor 2, and to further reduce lowering of the reliability of the air-conditioning apparatus 1.

As described above, in the existing outdoor heat exchanger including the heat transfer tubes, the distribution pipe, and the junction pipe, the two-phase gas-liquid refrigerant is easily non-uniformly distributed to the heat transfer tubes. In other words, in the existing outdoor heat exchanger including the heat transfer tubes, the distribution pipe, and the junction pipe, the variance between the speeds of the two-phase gas-liquid refrigerant that flows through the heat transfer tubes is easily increased. Therefore, in the existing outdoor heat exchanger including the heat transfer tubes, the distribution pipe, and the junction pipe, in some of the heat transfer tubes, in some cases, the two-phase gas-liquid refrigerant flows does not flow at a sufficient speed to carry the refrigerating machine oil. In particular, in an outdoor heat exchanger in which the amount of flowing refrigerant is adjusted based on a heat exchange load, in some of the heat transfer tubes, in many cases, the two-phase gas-liquid refrigerant does not flow at a sufficient speed to carry the refrigerating machine oil. Furthermore, in the existing outdoor heat exchanger including the heat transfer tubes, the distribution pipe, and the junction pipe, each of the heat transfer tubes extends in the lateral direction. Therefore, in the existing outdoor heat exchanger including the heat transfer tubes, the distribution pipe, and the junction pipe, in some cases, the refrigerating machine oil is accumulated in some of the heat transfer tubes at which the two-phase gas-liquid refrigerant does not flow at a sufficient speed to carry the refrigerating machine oil, and the compressor runs short of the refrigerating machine oil in some cases.

In contrast, in the air-conditioning apparatus 1 according to the present embodiment, the two-phase gas-liquid refrigerant can be uniformly distributed to the heat transfer tubes, as compared with the existing air-conditioning apparatus as described above. That is, in the air-conditioning apparatus 1 according to the present embodiment, it is possible to reduce the variance between the speeds of the two-phase gas-liquid refrigerant that flows the heat transfer tubes. Therefore, in the air-conditioning apparatus 1 according to the present embodiment, it is possible to reduce the probability with which in a heat transfer tube or tubes, the two-phase gas-liquid refrigerant will not flow at a sufficient speed to carry the refrigerating machine oil. Furthermore, in the air-conditioning apparatus 1 according to the present embodiment, each of the heat transfer tubes extends in the upward/downward direction. Therefore, in the air-conditioning apparatus 1 according to the embodiment, it is also possible to reduce the probability with which the refrigerating machine oil will be accumulated in some of the heat transfer tubes, and as a result the inside of the compressor 2 will run short of refrigerating machine oil.

During the cooling operation in which the outdoor heat exchanger 41 operates as a condenser, the refrigerant flows in the opposite direction to the direction in which the refrigerant flows when the outdoor heat exchanger 41 operates as an evaporator. The high-temperature and high-pressure gas refrigerant discharged from the compressor 2 flows from the outflow pipe 47 into the first heat exchange unit 60. The refrigerant that has flowed into the first heat exchange unit 60 flows in the first heat exchange unit 60, and then flows into the second heat exchange unit 50. The refrigerant that has flowed into the second heat exchange unit 50 flows in the second heat exchange unit 50, and then flows out from the inflow pipe 45 to the outside of the outdoor heat exchanger 41.

In the above case, the controller 80 controls the opening degree of the expansion valve 5 and other valves to cause the high-pressure liquid refrigerant to flow out of the first heat exchange unit 60. As a result, the high-pressure liquid refrigerant that flows in the second heat exchange unit 50 is subcooled by the outdoor air, whereby it is possible to increase the degree of subcooling of the high-pressure liquid refrigerant that flows out of the outdoor heat exchanger 41. In other words, the second heat exchange unit 50 operates as a subcooling heat exchanger. By increasing the degree of subcooling of the high-pressure liquid refrigerant that flows out of the outdoor heat exchanger 41, it is possible to increase the cooling capacity of the air-conditioning apparatus 1 and reduce the electricity consumption of the air-conditioning apparatus 1, and obtains other advantages.

In the present embodiment, in order to achieve an energy-saving operation of the air-conditioning apparatus 1 in both the cooling operation and the heating operation, a the second heat exchange unit 50 is made such that the size of the second heat exchange unit 50 is larger than or equal to 15% of the size of the outdoor heat exchanger 41 and is less than or equal to 35% of the size of the outdoor heat exchanger 41. In the embodiment, the size of the second heat exchange unit 50 and the size of the outdoor heat exchanger 41 are defined as follows. The volume of a region where the heat transfer tubes 51 and the heat transfer tubes 52 are provided is determined as the size of the second heat exchange unit 50. The volume of a region where the heat transfer tubes 61 and the heat transfer tubes 62 are provided is determined as the size of the first heat exchange unit 60. The sum of the size of the second heat exchange unit 50 and the size of the first heat exchange unit 60 is determined as the size of the outdoor heat exchanger 41.

It will be described why the second heat exchange unit 50 is made to have the above size.

When the size of the second heat exchange unit 50 is excessively smaller than the size of the outdoor heat exchanger 41, the following problems arise. During the cooling operation in which the outdoor heat exchanger 41 operates as a condenser, it is not possible to ensure a desired degree of cooling. During the heating operation in which the outdoor heat exchanger 41 operates as an evaporator, the low-temperature and low-pressure two-phase gas-liquid refrigerant flows through the second heat exchange unit 50, and then flows into the first heat exchange unit 60. In this case, when the size of the second heat exchange unit 50 is small, the number of heat transfer tubes 51 and the number of heat transfer tubes 52 are reduced, and a cross-sectional area of the refrigerant flow passage in the second heat exchange unit 50 is reduced. As a result, during the heating operation in which the outdoor heat exchanger 41 operates as an evaporator, in the case where the size of the second heat exchange unit 50 is excessively smaller than the size of the outdoor heat exchanger 41, a pressure loss that occurs when the low-temperature and low-pressure two-phase gas-liquid refrigerant flows in the second heat exchange unit 50 is increased, and the heating capacity of the air-conditioning apparatus 1 is reduced. Therefore, as the result of examination by the inventors, it is concluded that in order to achieve an energy-saving operation of the air-conditioning apparatus 1 in both the cooling operation and the heating operation, preferably, the size of the second heat exchange unit 50 should be larger than or equal to 15% of the size of the outdoor heat exchanger 41.

In contrast, in the case where the size of the second heat exchange unit 50 is excessively larger than the size of the outdoor heat exchanger 41, the following problems arise. The size of the first heat exchange unit 60 is decreased as the size of the second heat exchange unit 50 is increased relative to the size of the outdoor heat exchanger 41. In the case where the size of the first heat exchange unit 60 is small, the number of heat transfer tubes 61 and the number of heat transfer tubes 62 are reduced, and the cross-sectional area of the refrigerant flow passage in the second heat exchange unit 50 is reduced. During the cooling operation in which the outdoor heat exchanger 41 operates as a condenser, the high-temperature and high-pressure gas refrigerant flows into the first heat exchange unit 60, and then, when flowing out of the first heat exchange unit 60, the refrigerant flows in the second heat exchange unit 50. In this case, in the case where the size of the first heat exchange unit 60 is excessively small, a pressure loss that occurs when the high-temperature and high-pressure gas refrigerant flows in the first heat exchange unit 60 is increased during the cooling operation in which the outdoor heat exchanger 41 operates as a condenser. As a result, for example, a desired degree of cooling cannot be ensured, the pressure of the refrigerant on a high-pressure side is excessively raised, and the electricity power consumption of the compressor 2 is increased. Therefore, an energy-saving operation of the air-conditioning apparatus 1 cannot be achieved during the cooling operation. Therefore, as a result of examination by the inventors, it is concluded that in order to achieve an energy-saving operation of the air-conditioning apparatus 1 in both the cooling operation and the heating operation, preferably, the size of the second heat exchange unit 50 should be less than or equal to 35% of the size of the outdoor heat exchanger 41.

As described above, the air-conditioning apparatus 1 according to the present embodiment includes the compressor 2 and the outdoor heat exchangers each of which operates as at least an evaporator. Each of the outdoor heat exchangers includes the first heat exchange unit 60. The first heat exchange unit 60 includes the plurality of heat transfer tubes 62, the junction pipe 64, the outflow pipe 47, the plurality of heat transfer tubes 61, the distribution pipe 63, and the connection part 65. The heat transfer tubes 62 extend in the upward/downward direction, and are arranged apart from each other in the lateral direction. When an associated one of the outdoor heat exchangers operates as an evaporator, the refrigerant that flows in each of the heat transfer tubes 62 flows out of the outflow-side end 62*b* that is the lower end of the heat transfer tube 62. The junction pipe 64 extends in the lateral direction, and the outflow-side ends 62*b* of the heat transfer tubes 62 are connected to the junction pipe 64. In addition, when the associated outdoor heat exchanger operates as an evaporator, the refrigerant that has flowed out of the of heat transfer tubes 62 join each other in the junction pipe 64. The outflow pipe 47 is connected to the junction pipe 64 at or below the center position of the junction pipe 64 in the upward/downward direction. In addition, when the associated outdoor heat exchanger operates as an evaporator, the outflow pipe 47 guides the refrigerant that has flowed out of the junction pipe 64 to the compressor 2. The heat transfer tubes 61 each extend in the upward/downward direction, and are arranged apart from each other in the lateral direction. When the associated outdoor heat exchanger operates as an evaporator, the refrigerant flows into each of the heat transfer tubes 61 from the inflow-side end 61*a* that is the lower end of the heat transfer tube 61. The distribution pipe 63 extends in the lateral direction, and the inflow-side ends 61*a* of the heat transfer tubes 61 are connected to the distribution pipe 63. When the associated outdoor heat exchanger operates as an evaporator, the distribution pipe 63 distributes the refrigerant that flows therein to the heat transfer tubes 61. The connection part 65 connects the upper end portions of the heat transfer tubes 62 and the upper end portions of the heat transfer tubes 61. When the associated outdoor heat exchanger operates as an evaporator, the connection part 65 guides the refrigerant that has flowed out of the heat transfer tubes 61 to the heat transfer tubes 62.

In the air-conditioning apparatus 1 according to the present embodiment, the junction pipe 64 extends in the lateral direction. The outflow pipe 47 is connected to the junction pipe 64 at or below the center position of the junction pipe 64 in the upward/downward direction. Therefore, in the air-conditioning apparatus 1 according to the embodiment, as described above, it is possible to reduce accumulation of the refrigerating machine oil in part of the junction pipe 64 where the refrigerating machine oil does not easily flows out from the outflow pipe 47, and to reduce shortage of the refrigerating machine oil in the compressor 2.

The invention claimed is:

1. An air-conditioning apparatus comprising:

a compressor; and an outdoor heat exchanger configured to operate as an evaporator and a condenser, wherein the outdoor heat exchanger includes a first heat exchange unit and a second heat exchange unit, the first heat exchange unit includes a plurality of first heat transfer tubes extending in an upward/downward direction, arranged apart from each other in a lateral direction, and having respective outflow-side ends from which refrigerant that flows in the plurality of first heat transfer tubes flows out when the outdoor heat exchanger operates as the evaporator, the outflow-side ends being lower ends of the plurality of first heat transfer tubes, a first junction pipe extending in the lateral direction, connected to the outflow-side ends of the plurality of first heat transfer tubes, and provided as a pipe in which the refrigerant that flows out of the plurality of first heat transfer tubes joins each other when the outdoor heat exchanger operates as the evaporator, an outflow pipe connected to the first junction pipe at or below a center position of the first junction pipe in the upward/downward direction, and configured to guide the refrigerant that flows out of the first junction pipe to the compressor when the outdoor heat exchanger operates as the evaporator, a plurality of second heat transfer tubes extending in the upward/downward direction, arranged apart from each other in the lateral direction, and having respective inflow-side ends from which the refrigerant flows into the plurality of second heat transfer tubes when the outdoor heat exchanger operates as the evaporator, the inflow-side ends being lower ends of the plurality of second heat transfer tubes, a first distribution pipe extending in the lateral direction, connected to the inflow-side ends of the plurality of second heat transfer tubes, and configured to distribute the refrigerant that flows through the first distribution pipe to the plurality of second heat transfer tubes when the outdoor heat exchanger operates as the evaporator, and a first connection part connecting upper ends of the plurality of first heat transfer tubes and upper ends of the plurality of second heat transfer tubes, and configured to guide the refrigerant that flows out of the plurality of second heat transfer tubes to the plurality of first heat transfer tubes when the outdoor heat exchanger operates as the evaporator, the second heat exchange unit includes a plurality of third heat transfer tubes extending in the upward/downward direction, arranged apart from each other in the lateral direction, and having respective outflow-side ends from which the refrigerant that flows in the plurality of third heat transfer tubes flows out when the outdoor heat exchanger operates as the evaporator, the outflow-side ends being lower ends of the plurality of third heat transfer tubes, a second junction pipe extending in the lateral direction, connected to the outflow-side ends of the plurality of third heat transfer tubes, and provided as a pipe into which the refrigerant flows from the plurality of third heat transfer tubes to join each other in the second junction pipe when the outdoor heat exchanger operates as the evaporator, a plurality of fourth heat transfer tubes extending in the upward/downward direction, arranged apart from each other in the lateral direction, and having respective inflow-side ends from which the refrigerant flow into the plurality of fourth heat transfer tubes when the outdoor heat exchanger operates as the evaporator, the respective inflow-side ends being lower ends of the plurality of fourth heat transfer tubes, a second distribution pipe extending in the lateral direction, connected to the inflow-side ends of the plurality of fourth heat transfer tubes, and configured to distribute the refrigerant that flows in the second distribution pipe to the plurality of fourth heat transfer tubes when the outdoor heat exchanger operates as the evaporator, and a second connection part connecting upper ends of the plurality of third heat transfer tubes and upper ends of the plurality of fourth heat transfer tubes, and configured to guide the refrigerant that flows out of the plurality of fourth heat transfer tubes to the plurality of third heat transfer tubes when the outdoor heat exchanger operates as the evaporator, the second junction pipe is connected to the first distribution pipe, and the second heat exchange unit has a size that is larger than or equal to 15% of a size of the outdoor heat exchanger and less than or equal to 35% of the size of the outdoor heat exchanger.

2. The air-conditioning apparatus of claim 1, wherein the first distribution pipe includes an inner pipe and an outer pipe, the inner pipe being a pipe through which the refrigerant supplied to the first distribution pipe flows, and including a plurality of orifices that penetrate part of the inner pipe, the outer pipe being a pipe that is located outward of the inner pipe and into which the refrigerant flows out from the inner pipe through the orifices, and the inflow-side ends of the plurality of second heat transfer tubes are connected to the outer pipe.

3. The air-conditioning apparatus of claim 2, wherein the inner pipe is formed such that an inside diameter of part of the inner pipe that is located in a range from an end of the inner pipe to a location separated from the end by a predetermined distance is smaller than an inside diameter of an other part of the inner pipe, the end of the inner pipe being an end located on a downstream side in a flow direction of the refrigerant in the inner pipe when the outdoor heat exchanger operates as the evaporator, the other part of the inner pipe being located upstream of the range in the flow direction of the refrigerant in the inner pipe when the outdoor heat exchanger operates as the evaporator.

4. The air-conditioning apparatus of claim 2, wherein where an arbitrary one of the plurality of orifices is a first orifice, and the others of the plurality of orifices are second orifices, an inside diameter of at least one of the second orifices is different from an inside diameter of the first orifice.

5. The air-conditioning apparatus of claim 2, wherein where an arbitrary one of the plurality of orifices is a third orifice, and the others of the plurality of orifices are fourth orifices, in the upward/downward direction, at least one of the fourth orifices is formed at a different positon from a position at which the third orifice is formed.

6. The air-conditioning apparatus of claim 1, further comprising:

a plurality of outdoor heat exchangers including the outdoor heat exchanger;

a housing having a quadrangular shape as viewed in plan view; and a fan housed in the housing, wherein air inlets are provided in respective side surfaces of the housing, the plurality of outdoor heat exchangers are each formed to have a L-shape or a linear shape as viewed in plan view, and four sides of the fan are surrounded by the plurality of outdoor heat exchangers as viewed in plan view.

7. The air-conditioning apparatus of claim 1, further comprising a plurality of sets of flow switching devices, outdoor heat exchangers including the outdoor heat exchanger, and expansion valves, the sets of flow switching devices, outdoor heat exchangers, and expansion valves being connected in parallel, the flow switching device, the outdoor heat exchanger and the expansion valve of each of the plurality of sets are connected in series, wherein where when one or more of the plurality of outdoor heat exchangers operate as evaporators, one or more of the plurality of the outdoor heat exchangers that do not operate as evaporators are first resting outdoor heat exchangers, of the flow switching devices, a flow switching device or flow switching devices each of which is connected to an associated one of the first resting outdoor heat exchangers are each configured to cause a discharge side of the compressor and the associated first resting outdoor heat exchanger to communicate with each other, and of the expansion valves, an expansion valve or expansion valves each of which is connected to an associated one of the first resting outdoor heat exchangers are each configured to adjust a flow rate of the refrigerant that flows through the associated first resting outdoor heat exchanger.

8. The air-conditioning apparatus of claim 7, wherein each of the plurality of outdoor heat exchangers is configured to be also capable of operating as a condenser, and where when one or more of the plurality of outdoor heat exchangers operates as condensers, one or more of the plurality of outdoor heat exchangers that do not operate as condensers are second resting outdoor heat exchangers, of the flow switching devices, a flow switching device or flow switching devices each of which is connected to an associated one of the second resting outdoor heat exchangers are each configured to cause a suction side of the compressor and the associated second resting outdoor heat exchanger to communicate with each other, and of the expansion valves, an expansion valve or expansion valves each of which is connected to an associated one of the second resting outdoor heat exchangers are each configured to adjust a flow rate of the refrigerant that flows in the associated second resting outdoor heat exchanger.

* * * * *